US010975323B2

(12) United States Patent
Salem et al.

(10) Patent No.: US 10,975,323 B2
(45) Date of Patent: Apr. 13, 2021

(54) SULFURIZED CATECHOLATE DETERGENTS FOR LUBRICATING COMPOSITIONS

(71) Applicant: THE LUBRIZOL CORPORATION, Wickliffe, OH (US)

(72) Inventors: Kamalakumari K. Salem, Wickliffe, OH (US); Gary M. Walker, Hazelwood (GB); Ewan E. Delbridge, Wickliffe, OH (US); David J. Moreton, Hazelwood (GB); Adam Cox, Wickliffe, OH (US); W. Preston Barnes, Concord, OH (US); James P. Roski, Wickliffe, OH (US); Mohamed G. Fahmy, Wickliffe, OH (US)

(73) Assignee: THE LUBRIZOL CORPORATION, Wickliffe, OH (US)

( * ) Notice: Subject to any disclaimer, the term of this patent is extended or adjusted under 35 U.S.C. 154(b) by 269 days.

(21) Appl. No.: 15/781,005

(22) PCT Filed: Dec. 7, 2016

(86) PCT No.: PCT/US2016/065279

§ 371 (c)(1),
(2) Date: Jun. 1, 2018

(87) PCT Pub. No.: WO2017/105948

PCT Pub. Date: Jun. 22, 2017

(65) Prior Publication Data

US 2020/0283694 A1 Sep. 10, 2020

Related U.S. Application Data

(60) Provisional application No. 62/267,511, filed on Dec. 15, 2015.

(51) Int. Cl.

| | |
|---|---|
| ***C10M 135/30*** | (2006.01) |
| ***C10M 101/00*** | (2006.01) |
| ***C10M 107/00*** | (2006.01) |
| *C10N 30/04* | (2006.01) |
| *C10N 30/00* | (2006.01) |
| *C10N 20/02* | (2006.01) |
| *C10N 30/06* | (2006.01) |
| *C10N 30/10* | (2006.01) |
| *C10N 30/12* | (2006.01) |
| *C10N 40/04* | (2006.01) |
| *C10N 40/25* | (2006.01) |
| *C10N 60/10* | (2006.01) |
| *C10N 70/00* | (2006.01) |

(52) U.S. Cl.

CPC ..... *C10M 135/30* (2013.01); *C10M 101/00* (2013.01); *C10M 107/00* (2013.01); *C10M 2207/026* (2013.01); *C10M 2207/262* (2013.01); *C10M 2219/06* (2013.01); *C10N 2020/02* (2013.01); *C10N 2030/041* (2020.05); *C10N 2030/06* (2013.01); *C10N 2030/10* (2013.01); *C10N 2030/12* (2013.01); *C10N 2030/26* (2020.05); *C10N 2040/04* (2013.01); *C10N 2040/25* (2013.01); *C10N 2060/10* (2013.01); *C10N 2070/00* (2013.01)

(58) Field of Classification Search

CPC ..... C10M 135/28; C10M 135/30; C10M 2219/087; C10M 2219/088; C10M 2219/089; C10N 2030/04; C10N 2040/25

See application file for complete search history.

(56) References Cited

U.S. PATENT DOCUMENTS

| | | | |
|---|---|---|---|
| 2,680,096 | A | 6/1954 | Walker et al. |
| 3,036,971 | A | 5/1962 | Otto |
| 3,172,892 | A | 3/1965 | Le Suer et al. |
| 3,197,405 | A | 7/1965 | Le Suer |
| 3,219,666 | A | 11/1965 | Norman et al. |
| 3,316,177 | A | 4/1967 | Dorer, Jr. |
| 3,340,281 | A | 9/1967 | Brannen, Jr. |
| 3,351,552 | A | 11/1967 | Le Suer |
| 3,372,116 | A | 3/1968 | Meinhardt |
| 3,381,022 | A | 4/1968 | Le Suer |
| RE26,433 | E | 8/1968 | Le Suer |
| 3,433,744 | A | 3/1969 | Le Suer |
| 3,444,170 | A | 5/1969 | Norman et al. |
| 3,467,668 | A | 9/1969 | Gruber et al. |
| 3,501,405 | A | 3/1970 | Willette |
| 3,542,680 | A | 11/1970 | Le Suer |
| 3,576,743 | A | 4/1971 | Wldmer et al. |
| 3,632,511 | A | 1/1972 | Liao |
| 3,778,371 | A | 12/1973 | Malec |
| 3,816,353 | A | 6/1974 | Sharman et al. |

(Continued)

FOREIGN PATENT DOCUMENTS

| | | |
|---|---|---|
| EP | 0 355 895 A2 | 2/1990 |
| EP | 2374866 A1 | 10/2011 |

(Continued)

*Primary Examiner* — Vishal V Vasisth

(74) *Attorney, Agent, or Firm* — Christopher P. Demas; Teresan W. Gilbert

(57) ABSTRACT

A lubricating composition includes a sulfurized oxy-substituted aromatic polyol compound and an oil of lubricating viscosity. The sulfurized oxy-substituted aromatic polyol compound includes at least one of a sulfurized oxy-substituted aromatic polyol and a salt of a sulfurized oxy-substituted aromatic polyol. The compound is suitable as a replacement for detergents that contain $C_n$ alkyl phenols derived from oligomers of propylene.

14 Claims, No Drawings

(56) References Cited

U.S. PATENT DOCUMENTS

| | | | |
|---|---|---|---|
| 3,864,286 | A | 2/1975 | Anderson |
| 3,962,104 | A | 6/1976 | Marian et al. |
| 4,058,472 | A | 11/1977 | Kablaoui |
| 4,115,287 | A | 9/1978 | Colclough et al. |
| 4,171,959 | A | 10/1979 | Vartanian |
| 4,221,673 | A | 9/1980 | Robson et al. |
| 4,234,435 | A | 11/1980 | Meinhardt et al. |
| 4,253,980 | A | 3/1981 | Hammond et al. |
| 4,326,973 | A | 4/1982 | Hammond et al. |
| 4,338,206 | A | 7/1982 | Hammond et al. |
| 4,643,838 | A | 2/1987 | Liston et al. |
| 4,729,848 | A | 3/1988 | Yamaguchi et al. |
| 5,254,138 | A | 10/1993 | Kurek |
| 5,259,966 | A | 11/1993 | Burke, Jr. et al. |
| 5,510,043 | A | 4/1996 | Inoue |
| 5,534,168 | A | 7/1996 | Cleverley et al. |
| 6,015,778 | A | 1/2000 | Rolfes et al. |
| 6,153,565 | A | 11/2000 | Skinner et al. |
| 6,165,235 | A | 12/2000 | Kolp et al. |
| 6,235,688 | B1 | 5/2001 | Small et al. |
| 6,268,318 | B1 | 7/2001 | Rolfes et al. |
| 6,281,179 | B1 | 8/2001 | Skinner et al. |
| 6,310,009 | B1 | 10/2001 | Kocsis et al. |
| 6,329,327 | B1 | 12/2001 | Tanaka et al. |
| 6,429,178 | B1 | 8/2002 | Skinner et al. |
| 6,429,179 | B1 | 8/2002 | Skinner et al. |
| 6,559,105 | B2 | 5/2003 | Abraham et al. |
| 6,914,037 | B2 | 7/2005 | Gatto |
| 7,238,650 | B2 | 7/2007 | Calder et al. |
| 7,285,516 | B2 | 10/2007 | Carrick et al. |
| 7,435,709 | B2 | 10/2008 | Stonebraker et al. |
| 7,727,943 | B2 | 6/2010 | Brown et al. |
| 8,772,209 | B2 | 7/2014 | Mahieux et al. |
| 9,062,271 | B2 | 6/2015 | Jukes et al. |
| 2004/0077507 | A1 | 4/2004 | Lange et al. |
| 2005/0065045 | A1 | 3/2005 | Wilk et al. |
| 2005/0198894 | A1 | 9/2005 | Migdal et al. |
| 2005/0288194 | A1 | 12/2005 | Small et al. |
| 2006/0014651 | A1 | 1/2006 | Esche et al. |
| 2006/0079413 | A1 | 4/2006 | Kocsis et al. |
| 2006/0183647 | A1 | 8/2006 | Kocsis et al. |
| 2007/0049508 | A1 | 3/2007 | Stonebraker et al. |
| 2008/0119378 | A1 | 5/2008 | Gandon et al. |
| 2008/0269351 | A1 | 10/2008 | Campbell et al. |
| 2008/0280795 | A1 | 11/2008 | Fujitsu et al. |
| 2009/0054278 | A1 | 2/2009 | Baumanis et al. |
| 2010/0081592 | A1 | 4/2010 | Kocsis et al. |
| 2010/0197536 | A1 | 8/2010 | Mosier et al. |
| 2011/0118160 | A1 | 5/2011 | Campbell et al. |
| 2011/0124539 | A1 | 5/2011 | Sinquin et al. |
| 2011/0190185 | A1 | 8/2011 | Sinquin et al. |
| 2013/0203639 | A1 | 8/2013 | Roski et al. |
| 2014/0130757 | A1 | 5/2014 | Marsh et al. |
| 2014/0130767 | A1 | 5/2014 | Leitl |
| 2015/0045269 | A1 | 2/2015 | Walker et al. |

FOREIGN PATENT DOCUMENTS

| | | | |
|---|---|---|---|
| EP | 2682451 | A1 | 1/2014 |
| WO | WO 2008/147704 | | 4/2008 |
| WO | WO 2013/059173 | A1 | 4/2013 |
| WO | WO 2014/193543 | A1 | 12/2014 |
| WO | WO 2016/138227 | A1 | 9/2016 |

SULFURIZED CATECHOLATE DETERGENTS FOR LUBRICATING COMPOSITIONS

This application claims the benefit of PCT/US2016/65279, filed on Dec. 7, 2016, and U.S. Provisional Application No. 62/267,511, filed on Dec. 15, 2015, from which the PCT application claims priority, the disclosures of which are incorporated herein by reference in their entireties.

BACKGROUND

The exemplary embodiment relates to lubricant additives and in particular to sulfurized oxy-substituted aromatic polyols and salts thereof useful in lubricating compositions.

Thermal and mechanical stresses on lubricants, such as engine and driveline oils, tend to increase formation of deposits on the lubricated components, such as internal combustion engines and driveline components. This can negatively impact the performance of the lubricated components through reduction in engine efficiency or overall life-expectancy. Such lubricants generally incorporate, in addition to a base oil, a number of additives, including friction modifiers, antiwear agents, antioxidants, dispersants, and detergents, that are used to protect lubricated components from wear, oxidation, soot deposits, corrosion, acid build up, and the like, and to improve water tolerance and compatibility of formulation components.

Dispersants are used for dispersing impurities such as wear particles, soot and other contaminants. Amine-based dispersants, such as polyamine succinimides, have been widely used. These dispersants often have basic functionality which can help to neutralize acidic contaminants. However, they have a tendency to reduce corrosion protection and seals compatibility.

Salicylate and catecholate additives have been used to provide desirable performance attributes to lubricant formulations, including cleanliness, antioxidancy, and dispersancy.

Branched para-$C_{12}$-alkylphenols, including p-dodecylphenol (PDDP), formed from tetrapropene, have seen extensive commercial use as chemical intermediates in the production of oil and lubricant additives for gasoline and diesel-powered engines. Recently, however, some countries have placed limits on the amount PDDP which is considered acceptable. Therefore it is desirable to develop an alternative to PDDP and other alkylphenols for use as detergents.

There have been several efforts to prepare detergents that do not contain $C_n$ alkyl phenols derived from oligomers of propylene. These include U.S. Pub Nos. 2008/0269351, 2011/0118160, 2011/0124539, 2011/0190185, and WO 2013/059173. Other compounds are disclosed in U.S. Pat. Nos. 3,816,353, 3,864,286, 4,058,472, 4,221,673, 4,643,838, 4,729,848, 5,510,043, 6,235,688 and 6,310,009, and U.S. Pub. Nos. US 2007/0049508, 2005/0288194, 2004/077507, 2014/130767, WO 2014193543, and EP 2374866 A1.

BRIEF DESCRIPTION

In accordance with one aspect of the exemplary embodiment, a lubricating composition includes a sulfurized oxy-substituted aromatic polyol compound and an oil of lubricating viscosity. The compound includes at least one of a sulfurized oxy-substituted aromatic polyol and a salt of a sulfurized oxy-substituted aromatic polyol.

In accordance with another aspect of the exemplary embodiment, a method of forming a lubricating composition includes forming a salt, including: (i) reacting an aromatic polyol with at least one of an alpha olefin, an epoxide and a poly(ether) to form a hydroxy-substituted intermediate compound, (ii) sulfurizing the intermediate compound, and iii) reacting the at least one of the intermediate compound and the sulfurized intermediate compound with a metal base or pnictogen base. The salt is combined with an oil of lubricating viscosity.

In accordance with another aspect of the exemplary embodiment, a detergent includes a sulfurized oxy-substituted aromatic polyol compound, the compound comprising at least one of a sulfurized oxy-substituted aromatic polyol and a salt of a sulfurized oxy-substituted aromatic polyol. The sulfurized oxy-substituted aromatic polyol compound includes a sulfurized reaction product of an aromatic polyol, at least one of an epoxide and a poly(ether), and a metal base or pnictogen base.

DETAILED DESCRIPTION

Aspects of the exemplary embodiment relate to a sulfurized (e.g., sulfur-coupled) organic compound, a lubricating composition containing the compound, a method of lubrication and a use of the lubricating composition.

The exemplary lubricating composition includes an oil of lubricating viscosity (or "base oil") and a sulfur-coupled, oxy-substituted aromatic polyol compound that can serve as a dispersant or detergent in the lubricating composition.

A. The Compound

The exemplary sulfurized oxy-substituted aromatic polyol compound is a sulfurized aromatic phenol in which at least one of two or more hydroxyl groups directly bonded to an aromatic ring is substituted with a non-aromatic organic group, which is thereby bonded to the aromatic ring by the oxygen of what was previously an OH group, i.e., the —OH group(s) become(s) —O-Sub, where Sub represents the substituent.

The aromatic polyol on which the exemplary compound is based may be a substituted or unsubstituted compound that has at least two hydroxyl groups directly bonded to an aromatic group (within the definition of Hückel Rule $4\pi+2$ electrons) such as an optionally ring-substituted catechol, pyrogallol, resorcinol, or naphthalene-based polyol, such as naphthalene-2,3-diol, naphthalene-1,8-diol, naphthalene-1,5-diol, naphthalene-1,7-diol, or naphthalene-2,6-diol, hydroquinone, hydrocarbyl ester of gallic acid, mono- or di-alkylated derivatives of the same, or other aromatic diol or triol, or a mixture thereof. An exemplary oxy-substituted aromatic polyol compound may be represented by the general structure shown in Formula I:

Formula I

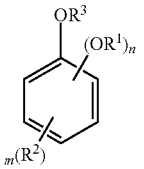

wherein each $R^1$ is independently selected from hydrocarbyl groups of 1 to 24 carbon atoms, hydroxyl substituted hydrocarbyl groups of 2 to 24 carbon atoms, (poly)ether groups (e.g., —($CH_2CH(R^4)$—O—)$_bR^6$), acyl groups (e.g., —C(O)$R^6$), and mixtures thereof;

$R^2$ is selected hydrocarbyl groups of 1 to 48 carbon atoms, hydroxyl substituted hydrocarbyl groups of 2 to 24 carbon atoms, (poly)ether groups (e.g., —($CH_2CH(R^4)$—O—)$_bR^6$), acyl groups containing 2 to 30 carbon atoms, groups in which two $R^2$ groups together form a 5- or 6-membered ring, which may be an aromatic ring, a cycloaliphatic ring, or a heterocyclic ring, and mixtures thereof;

$R^3$ is selected from H and hydroxyl substituted hydrocarbyl groups of 2 to 24 carbon atoms, and mixtures thereof;

$R^4$ is selected from hydrocarbyl groups of 1 to 48 carbon atoms and —$R^7$—S—$R^8$—;

$R^5$ is selected from H and hydrocarbyl groups of 1 to 48 carbon atoms;

$R^6$, and $R^8$ are independently selected from hydrocarbyl groups of 1 to 48 carbon atoms;

$R^7$ is selected from hydrocarbylene groups of 1 to 48 carbon atoms;

n is at least 1, such as 1 or 2;

m is at least 0, such as from 0 to 4, or up to 3, or at least 1;

b is at least 1, or at least 2.

An exemplary sulfurized oxy-substituted aromatic polyol compound may be represented by the general structure shown in Formula II:

Formula II

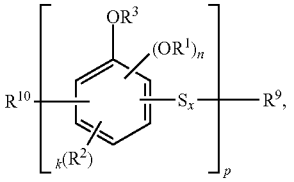

and salts thereof, wherein each $R^1$, $R^2$, $R^3$, n, and m are as defined above;

$R^9$ is selected from hydrogen, hydrocarbyl groups of 1 to 18 carbon atoms, phenol, alkylated phenols, catechol, alkylated catechols, oxy-substituted aromatic polyols, and combinations thereof;

$R^{10}$ is selected from hydrogen, hydroxyl, sulfhydryl (—SH), hydrocarbyl groups of 1 to 48 carbon atoms, hydroxyl substituted hydrocarbyl groups of 2 to 24 carbon atoms, (poly)ether groups (e.g., —($CH_2CHR^4$—O—)$_bR^5$), a 5- or 6-membered ring, which may be an aromatic ring, a cycloaliphatic ring, or a heterocyclic ring, and mixtures thereof;

n is at least 1;

k is at least 0; such as from 0 to 2; and x is at least 1, such as from 1 to 7 or from 1 to 4; and p is at least 1.

As will be appreciated, these aspects can also be used in combinations thereof. In the case of the salt, the exemplary compound of Formula II may serve as an anion and be associated with a cation serving as a counter ion in the compound.

Examples of hydrocarbyl groups suitable for use as $R^1$ include $C_1$-$C_{30}$ alkyl groups, such as methyl, propyl, butyl, pentyl, hexyl, heptyl, octyl, nonyl, decyl, undecyl, dodecyl, tridecyl, tetradecyl, pentadecyl, hexadecyl, heptadecyl, octadecyl, nonadecyl, and eicosyl groups, and mixtures thereof.

In one embodiment, $R^3$ is H.

In one embodiment, $R^7$ is H.

Examples of hydrocarbyl groups suitable for use as $R^5$, $R^6$, and $R^8$ include $C_1$-$C_{30}$ straight chain and branched alkyl and alkenyl groups, such as methyl, propyl, butyl, pentyl, hexyl, heptyl, octyl, nonyl, decyl, undecyl, dodecyl, tridecyl, tetradecyl, pentadecyl, hexadecyl, heptadecyl, octadecyl, nonadecyl, and eicosyl groups, and mixtures thereof.

Examples of hydrocarbylene groups suitable for use as $R^4$ and $R^7$ include $C_1$-$C_{30}$ straight chain and branched alkylene groups (bivalent saturated aliphatic groups) such as ethylene, propylene, etc., and mixtures thereof.

In some embodiments, $R^2$ is a hydrocarbyl group of 6 to 12 carbon atoms. $C_6$-$C_{12}$ alkyl and $C_6$-$C_{12}$ alkenyl groups useful as $R^2$ include straight chain and branched alkyl and alkenyl groups. Specific examples of branched alkyl groups include isooctyl and 2-ethylhexyl groups.

Cyclic structures useful as $NR^2R^2$ include optionally substituted heterocycles containing an additional hetero atom such as oxygen or nitrogen. Examples include 6-membered heterocycles where the additional heteroatom in the ring may be nitrogen. In this case, the additional nitrogen may be linked to one or more equivalent cyclic structures, such as a chain of up to 10, or up to 3 equivalent cyclic structures, on average.

In one embodiment, $R^9$ is an oxy-substituted aromatic polyol of the form:

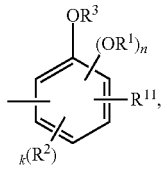

where $R^{11}$ may be —H, —SH, or an alkyl group of 1-24 carbon atoms.

For example, the compound of Formula II may be a sulfur-coupled di-oxyhydrocarbyl catecholate having the general structure of Formula III:

Formula III

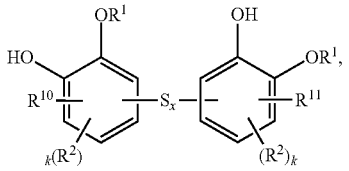

or salts thereof, where $R^1$, $R^2$, $R^9$, $R^{11}$, k, and x are as defined above.

In another embodiment the compound of Formula II has the general structure of any one of Formulas IV-V:

Formula IV

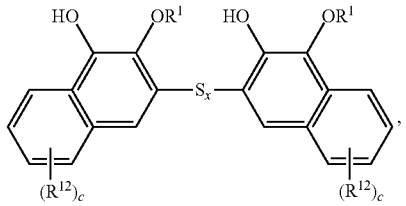

-continued

Formula V

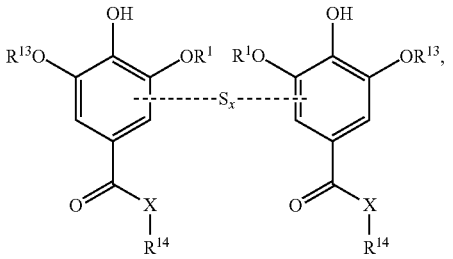

or a salt thereof, wherein each $R^{11}$, $R^{12}$, $R^{13}$, and $R^{14}$, may be independently selected from H and hydrocarbyl groups having from 1-28 carbon atoms, or 1-12 carbon atoms, or 1-4 carbon atoms;

c may be from 0-3;

X may be 0- or —$NR^{15}$—; and each $R^{15}$ may be independently selected from H and hydrocarbylene groups having from 1-28 carbon atoms, or 1-12 carbon atoms, or 1-4 carbon atoms.

In one embodiment, the compound of Formula II is a sulfur-coupled di-oxyhydrocarbyl catecholate or pyrogallate having the general structure of Formula VI:

Formula VI

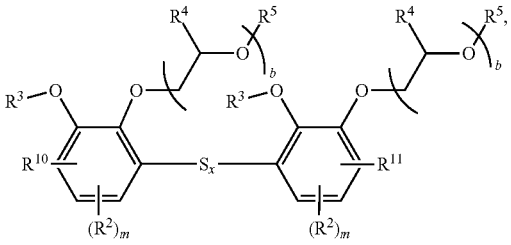

or a salt thereof.

Specific examples of Formula VI are as shown in TABLE 1:

TABLE 1

| $R^4$ | $R^2$ | $R^{10}$, $R^{11}$ | $R^3$ | $R^5$ | b |
|---|---|---|---|---|---|
| $C_{14}H_{29}$ | absent | H | H | H | 1 |
| $C_{10}H_{25}$ | absent | H | H | H | 1 |
| $C_{14}H_{29}$ | $C_{12}H_{25}$ | H | H | H | 1 |
| $C_{10}H_{25}$ | $C_{12}H_{25}$ | H | H | H | 1 |
| $C_2H_5$ | $C_{12}H_{25}$ | H | H | H | 1 |
| $C_2H_5$ | $C_{12}H_{25}$ | $C_{12}H_{25}$ | H | H | 1 |
| $C_2H_5$ | $C_{12}H_{25}$ | H | $-CH_2CH(OH)C_2H_5$ | H | 1 |
| $C_2H_5$ | $C_{20}$-$C_{24}$ | H | H | H | 1 |
| $CH_2$-S-$C_{12}H_{25}$ | absent | H | H | H | 1 |

In another embodiment, $R^9$ is an oxy-substituted aromatic polyol of the form:

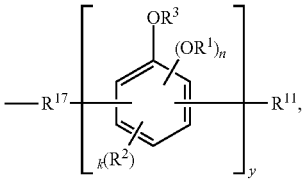

where y is at least 1; and $R^{17}$ is an optionally-sulfurized aromatic linking group, such as:

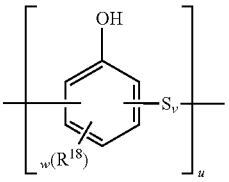

$R^{18}$ can be selected as for $R^2$, such as a hydrocarbyl group of 1 to 24, or 1 to 18, or 3 to 12 carbon atoms;

v is at least 0, such as 1-7;

u is at least 1, such as 1-5;

y is at least 1, such as 1-5;

w is at least 0, such as 0-3.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. By predominantly hydrocarbon character, it is meant that at least 70% or at least 80% of the atoms in the substituent are hydrogen or carbon. Hydrocarbylene groups are the bivalent equivalents of hydrocarbyl groups, i.e., are attached at each end to two parts of the remainder of the molecule.

Examples of hydrocarbyl groups include:

(i) hydrocarbon substituents, that is, aliphatic (e.g., alkyl or alkenyl), alicyclic (e.g., cycloalkyl, cycloalkenyl) substituents, aryl, and aromatic-, aliphatic-, and alicyclic-substituted aromatic substituents, as well as cyclic substituents wherein the ring is completed through another portion of the molecule (e.g., two substituents together form a ring);

(ii) substituted hydrocarbon substituents, that is, substituents containing non-hydrocarbon groups which, in the context of this invention, do not alter the predominantly hydrocarbon nature of the substituent (e.g., halo (especially chloro and fluoro), hydroxy, alkoxy, mercapto, alkylmercapto, nitro, nitroso, and sulfoxy);

(iii) hetero substituents, that is, substituents which, while having a predominantly hydrocarbon character, may contain other than carbon in a ring or chain otherwise composed of carbon atoms.

Representative alkyl groups useful as hydrocarbyl groups may include at least 1, or at least 2, or at least 3, or at least 4 carbon atoms, and in some embodiments, up to 150, or up to 100, or up to 80, or up to 40, or up to 30, or up to 28, or up to 24, or up to 20 carbon atoms. Illustrative examples include methyl, ethyl, propyl, butyl, pentyl, hexyl, heptyl, octyl, 2-ethylhexyl, nonyl, decyl, undecyl, dodecyl, tridecyl, tetradecyl, hexadecyl, stearyl, icosyl, docosyl, tetracosyl, 2-butyloctyl, 2-butyldecyl, 2-hexyloctyl, 2-hexydecyl, 2-octyldecyl, 2-hexyldodecyl, 2-octyldodecyl, 2-decyltetradecyl, 2-dodecylhexadecyl, 2-hexyldecyloctyldecyl, 2-tetradecyloctyldecyl, 4-methyl-2-pentyl, 2-propylheptyl, monomethyl branched-isostearyl, isomers thereof, mixtures thereof, and the like.

Representative alkenyl groups useful as hydrocarbyl groups include $C_2$-$C_{28}$ alkenyl groups, such as ethynyl, 2-propenyl, 1-methylene ethyl, 2-butenyl, 3-butenyl, pentenyl, hexenyl, heptenyl, octenyl, 2-ethylhexenyl, nonenyl, decenyl, undecenyl, dodecenyl, tridecenyl, tetradecenyl, hexadecenyl, isomers thereof, mixtures thereof, and the like.

Representative alicyclic groups useful as hydrocarbyl groups include cyclobutyl, cyclopentyl, and cyclohexyl groups.

Representative aryl groups include phenyl, toluyl, xylyl, cumenyl, mesityl, benzyl, phenethyl, styryl, cinnamyl, benzhydryl, trityl, ethylphenyl, propylphenyl, butylphenyl, pentylphenyl, hexylphenyl, heptylphenyl, octylphenyl, nonylphenyl, decylphenyl, undecylphenyl, dodecylphenyl, benzylphenyl, styrenated phenyl, p-cumylphenyl, α-naphthyl, β-naphthyl groups, and mixtures thereof.

Representative heteroatoms include sulfur, oxygen, nitrogen, and encompass substituents, such as pyridyl, furyl, thienyl and imidazolyl. In general, no more than two, and in one embodiment, no more than one, non-hydrocarbon substituent will be present for every ten carbon atoms in the hydrocarbyl group. In some embodiments, there are no non-hydrocarbon substituents in the hydrocarbyl group.

An "oxy-substituted group," as used herein, is a group in which oxygen is linked directly to a non-aromatic group, as in —OR' described above. In one embodiment, the oxy-substituted group is an oxy-hydrocarbyl substituted group, e.g., where $R^1$ is a hydrocarbyl group.

The term "catecholate" refers to a derivative of 1,2-dihydroxy benzene which is optionally further substituted on the aromatic ring. The term catecholate is also used herein to refer to derivatives in which the aromatic ring is further hydroxy-substituted, as in tri-hydroxy benzene, e.g., pyrogallol, a 1,2,3-trihydroxybenzene, in the case where $R^2$ or $R^3$ is OH. At least one of the OH groups of the catecholate is substituted with a non-aromatic organic group, such as a hydrocarbyl group.

An exemplary sulfur-coupled oxy-hydrocarbyl substituted catecholate compound thus includes an oxyhydrocarbyl group as a substituent on one or more of the aromatic rings that are joined by the sulfur bridge (i.e., $R^1$ replaces H in approximately one (or more) of the OH groups of each catechol, leaving at least one hydroxyl group on the aromatic ring unsubstituted).

In the Formulas I-VI, each $R^1$ may be non-aromatic hydrocarbyl group, i.e., $R^1$ is not an aryl group. In one embodiment, $R^1$ is an aliphatic group. In one embodiment, $R^1$ is selected from alkyl and alkenyl groups, such as $C_1$ to $C_{28}$ alkyl or alkenyl groups, or $C_4$ to $C_{24}$ alkyl or alkenyl groups, or $C_6$ to $C_{20}$ alkyl or alkenyl groups. In one embodiment, each $R^1$ is at least a $C_4$, or at least a $C_6$, or at least a $C_8$, or at least a $C_{10}$ alkyl or alkenyl group, and may be up to $C_{24}$ alkyl or alkenyl, or up to $C_{20}$ alkyl or alkenyl, or up to $C_{18}$ alkyl or alkenyl, or up to $C_{16}$ alkyl or alkenyl. The alkyl or alkenyl group may be linear or branched. In one embodiment, the alkyl or alkenyl group is branched to improve oil solubility. As an example, at least one $R^1$ may be a dodecyl group derived from tetrapropene.

In one embodiment, each $R^1$ is an unsubstituted hydrocarbyl group.

In another embodiment, $R^1$ may be non-aromatic hydroxy-substituted hydrocarbyl group, in which an aliphatic alkyl or alkenyl group, as described above, is substituted with one or more hydroxyl groups.

In one embodiment, at least one $R^1$ is a hydrocarbyl group that includes no substituents other than one or more hydroxyl groups.

In another embodiment, $R^1$ is selected from acyl and/or poly(ether groups).

Representative poly(ether) groups useful as $R^1$, and/or $R^2$ include those of the general structure $—(CH_2CH(R^4)—O—)_bR^5$, where $R^4$ and $R^5$ may be formed by polymerization of epoxides, such as ethylene oxide, propylene oxide, and/or butylene oxide.

Representative acyl groups useful as $R^1$, $R^2$ include acylated hydrocarbyl groups of 2 to 30 carbon atoms (where the acyl carbon is counted as one of the carbons), or up to 18 carbon atoms, or up to 6 carbon atoms, or at least 8 carbon atoms.

In Formulas I-VI, each $R^2$ may be independently selected from hydrocarbyl groups, as described more generally above, poly(ether) groups, and acyl groups.

In one embodiment, x is up to 7, on average, such as 1 or 2.

In one embodiment, p is up to 20, or up to 18, or up to 4, such as 1 or 2.

In one embodiment, b is up 20, or up to 18, or up to 4, such as 1 or 2.

The salt of the compound of any one of Formulas I-VI may be formed by reacting a cation or source of the cation with the compound. The compound of Formula I-VI thus serves as the anion (or "substrate") in the salt. The cation or source thereof reacts with one or more of the residual OH groups to form a neutral or overbased salt of the above-described sulfur-coupled oxy-substituted aromatic polyol.

The exemplary salt may be loosely represented as:

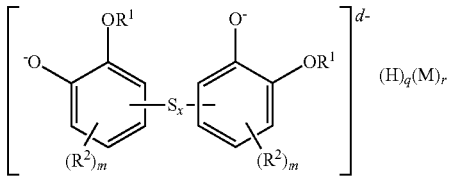

where d is at least 1; q and r are selected as appropriate to satisfy the valence of d; r is not zero; and M is a metallic or pnictogen cation, or mixtures thereof.

However, it is to be appreciated that the salt may include reaction products of the compound of Formula II with a source of the cation M which do not conform to this structure. In one embodiment, the cation has an atomic weight of at least 6, or at least 10, or at least 12.

In one embodiment, the cation is a metallic cation. The metallic cation may be derived from an alkaline earth metal, such as calcium, barium or magnesium (typically calcium), or an alkali metal, such as sodium or potassium (typically sodium).

Exemplary metal cations include alkali metal cations, alkaline earth metal cations, transition metal cations, and combinations thereof. Examples of metal cations include $Li^+$, $Na^+$, $K^+$, $Rb^+$, $Cs^+$, $Be^{2+}$, $Mg^{2+}$, $Ca^{2+}$, $Sr^{2+}$, $Ba^{2+}$, $Sc^{3+}$, $Sc^{2+}$, $Sc^+$, $Y^{3+}$, $Y^{2+}$, $Y^+$, $Ti^{4+}$, $Ti^{3+}$, $Ti^{2+}$, $Zr^{4+}$, $Zr^{3+}$, $Zr^{2+}$, $Hf^{4+}$, $Hf^{3+}$, $V^{4+}$, $V^{3+}$, $V^{2+}$, $Nb^{4+}$, $Nb^{3+}$, $Nb^{2+}$, $Ta^{4+}$, $Ta^{3+}$, $Ta^{2+}$, $Cr^{4+}$, $Cr^{3+}$, $Cr^{2+}$, Cr+, $Mo^{4+}$, $Mo^{3+}$, $Mo^{2+}$, $Mo^+$, $W^{4+}$, $W^{3+}$, $W^{2+}$, $W^+$, $Mn^{4+}$, $Mn^{3+}$, $Mn^{2+}$, $Mn^+$, $Re^{4+}$, $Re^{3+}$, $Re^{2+}$, $Re^+$, $Fe^{6+}$, $Fe^{4+}$, $Fe^{3+}$, $Fe^{2+}$, $Fe^+$, $Ru^{4+}$, $Ru^{3+}$, $Ru^{2+}$, $Os^{4+}$, $Os^{3+}$, Os+, $Co^{5+}$, $Co^{4+}$, $Co^{3+}$, $Co^{2+}$, $Co^{+}$, $Rh^{4+}$, $Ru^{3+}$, $Rh^{2+}$, $Rh^{+}$, $Ir^{4+}$, $Ir^{3+}$, $Ir^{2+}$, $Ir^{+}$, $Ni^{3+}$, $Ni^{2+}$, $Ni^{+}$, $Pd^{4+}$, $Pd^{2+}$, $Pd^{+}$, $Pt^{4+}$, $Pt^{3+}$, $Pt^{2+}$, $Pt^{+}$, $Cu^{4+}$, $Cu^{3+}$, $Cu^{2+}$, $Cu^{+}$, $Ag^{3+}$, $Ag^{2+}$, $Ag^{+}$, $Au^{4+}$, $Au^{3+}$, $Au^{2+}$, $Au^{+}$, $Zn^{2+}$, $Zn^{+}$, $Cd^{2+}$, $Cd^{+}$, $Hg^{4+}$, $Hg^{2+}$, $Hg^{+}$, $Al^{3+}$, $Al^{2+}$, $Al^{+}$, $Ga^{3+}$, $Ga^{-}$, $In^{3+}$, $In^{2+}$, $Tl^{3+}$, $Tl^{+}$, $Si^{4+}$, $Si^{3+}$, $Si^{2+}$, $Si^{+}$, $Ge^{4+}$, $Ge^{3+}$, $Ge^{2+}$, $Ge^{+}$, $Sn^{4+}$, $Sn^{2+}$, $Pb^{4+}$, $Pb^{2+}$, $As^{3+}$, $As^{2+}$, $As^{+}$, $Sb^{3+}$, $Bi^{3+}$, $Te^{4+}$, $Te^{2+}$, $La^{3+}$, $La^{2+}$, $Ce^{4+}$, $Ce^{3+}$, $Ce^{2+}$, $Pr^{4+}$, $Pr^{3+}$, $Pr^{2+}$, $Nd^{3+}$, $Nd^{2+}$, $Sm^{3+}$, $Sm^{2+}$, $Eu^{3+}$, $Eu^{2+}$, $Gd^{3+}$, $Gd^{2+}$, $Gd^{+}$, $Tb^{4+}$, $Tb^{3+}$, $Tb^{2+}$, $Tb^{+}$, $Db^{3+}$, $Db^{++}$, $Ho^{3+}$, $Er^{3+}$, $Tm^{4+}$, $Tm^{3+}$, $Tm^{2+}$, $Yb^{3+}$, $Yb^{2+}$, and $Lu^{3+}$. Particularly useful are those which form stable salts, i.e., which do not decompose by more than a minor amount over the expected lifetime and operating conditions of the lubricating composition.

In one embodiment, the metallic cation is derived from a metal base such as a metal base of a hydroxide, an oxide, carbonate, or bicarbonate. The metal base may be a hydroxide or an oxide. For example the metallic cation may be derived from calcium hydroxide, calcium oxide, sodium hydroxide, sodium oxide, magnesium hydroxide, magnesium oxide, or mixture thereof.

In one embodiment, the cation is an ash-free cation. An ash-free (ashless) organic cation is an organic ion that does not contain ash-forming metals. In one embodiment, the compound in the salt form has a sulfated ash of up to 0.5 wt. %, or up to 0.4 wt. %, according to ASTM D874-13a, Standard Test Method for Sulfated Ash from Lubricating Oils and Additives, DOI: 10.1520/D0874, ASTM International, West Conshohocken, Pa., 2013.

In one embodiment, the cation is a pnictogen cation. As used herein the term "pnictogens" includes the elements in column 15 of the periodic table. The non-metallic pnictogens include nitrogen and phosphorus (typically nitrogen). The pnictogen cation may be derived from a source of the cation containing a primary amine, a secondary amine, a tertiary amine, or mixture thereof. In one embodiment, the amine salt may be derived from a secondary or tertiary amine.

When the cation is pnictogen cation derived from an amine or ammonium compound, the pnictogen cation (or the amine from which it is derived) may have molecular weight of at least 260 g/mol, or at least 300 g/mol or at least 350 g/mol, or at least 500 g/mol.

The pnictogen cation may be derived from a mono-, di-, or tri-substituted amine. Specific examples include primary alkylamines, such as methylamine, ethylamine, n-propylamine, n-butylamine, n-hexylamine, n-octylamine, 2-ethylhexylamine, benzylamine, 2-phenylethylamine, cocoamine, oleylamine, and tridecylamine (CAS #86089-17-0); secondary and tertiary alkylamines such as isopropylamine, sec-butylamine, t-butylamine, cyclopentylamine, cyclohexylamine, and 1-phenylethylamine; dialkylamines, such as dimethylamine, diethylamine, dipropylamine, diisopropylamine, dibutylamine, dicyclohexylamine, di-(2-ethylhexyl)amine, dihexylamine, ethylbutylamine, N-ethylcyclohexylamine, and N-methylcyclohexylamine; cycloalkylamines, such as piperidine, N-ethylpiperidine, N,N'-dimethylpiperazine, morpholine, N-methylmorpholine, N-ethylmorpholine, N-methylpiperidine, pyrrolidine, N-methylpyrrolidine, and N-ethylpyrrolidine; and trialkylamines, such as trimethylamine, triethylamine, tripropylamine, triisopropylamine, tri-n-butylamine, trihexylamine, N,N-dimethylbenzylamine, dimethylethylamine, dimethylisopropylamine, dimethylbutylamine, and N,N-dimethylcyclohexylamine.

When the pnictogen cation includes at least one hydrocarbyl group (a quaternary ammonium ion), the pnictogen cation may be an ashless organic cation. Example ammonium cations of this type include N-substituted long chain alkenyl succinimides and aliphatic polyamines. N-substituted long chain alkenyl succinimides useful herein may be derived from an aliphatic polyamine, or mixture thereof. The aliphatic polyamine may be aliphatic polyamine such as an ethylenepolyamine, a propylenepolyamine, a butylenepolyamine, or mixture thereof. Examples of N-substituted long chain alkenyl succinimides include polyisobutylene succinimide with number average molecular weight of the polyisobutylene substituent of at least 350, or at least 500, or at least 550, or at least 750, and can be up to 5000, or up to 3000, or up to 2500. Such succinimides can be formed, for example, from high vinylidene polyisobutylene and maleic anhydride.

Example N-substituted long chain alkenyl succinimides useful herein as pnictogen cations include those derived from succinimide dispersants, which are more fully described in U.S. Pat. Nos. 3,172,892, 3,219,666, 3,316,177, 3,340,281, 3,351,552, 3,381,022, 3,433,744, 3,444,170, 3,467,668, 3,501,405, 3,542,680, 3,576,743, 3,632,511, 4,234,435, RE 26,433, 6,165,235, 7,238,650, and EP Patent Application 0 355 895 A.

Example aliphatic polyamines useful as the pnictogen cation include ethylenepolyamines, propylenepolyamines, butylenepolyamines, and mixtures thereof. Example ethylenepolyamines include ethylenediamine, diethylenetriamine, triethylenetetramine, tetraethylenepentamine, pentaethylene-hexamine, polyamine still bottoms, and mixtures thereof.

In one embodiment, the exemplary sulfur-coupled oxyhydrocarbyl catecholate salt may be overbased, i.e., contain an excess of the metal cation in relation to the number of hydroxyl groups present in the compound.

Total base number (TBN), as used herein, is the quantity of acid, expressed in terms of the equivalent number of milligrams of potassium hydroxide (meq KOH), that is required to neutralize all basic constituents present in 1 gram of a sample of the lubricating oil. The TBN values reported herein are determined according to ASTM Standard D2896-11, "Standard Test Method for Base Number of Petroleum Products by Potentiometric Perchloric Acid Titration" (2011), ASTM International, West Conshohocken, PA, 2003 DOI: 10.1520/D2896-11 (hereinafter, "D2896"). In various aspects, the neutral salt compound has a TBN of at least 50 mg of KOH/g, or at least 60 mg of KOH/g on an oil-free basis. The TBN of the neutral salt may be up to 300 mg KOH/g, or up to 250 mg KOH/g, or up to 165 mg KOH/g, on an oil-free basis. In various aspects, the lubricating composition containing the compound has a TBN of at least 3 mg KOH/g, or at least 4 mg of KOH/g, or at least 6 mg of KOH/g.

Base Number (BN) is another method for measuring the base number, and is measured according to ASTM D4739-11, Standard Test Method for Base Number Determination by Potentiometric Hydrochloric Acid Titration, ASTM International, West Conshohocken, Pa., 2011, DOI: 10.1520/D4739-11. In various aspects, the lubricating composition has a BN of at least 2.5 mg of KOH/g, or at least 2.8 mg of KOH/g.

The cation may serve as a basic component of the lubricating composition which, in combination with any other basic components of the lubricating composition, may provide the lubricating composition with TBN of at least 5, or at least 8, or at least 10, or at least 15, or at least 25. The cation itself may have a TBN of at least 10 or at least or at least 15, or at least 25, or at least 50.

The exemplary oxy-substituted aromatic polyol compound may a weight average molecular weight of at least 250, or at least 320.

Method of Forming the Compound

A sulfurized (e.g., sulfur-coupled) oxy-substituted aromatic compound of Formula II may be formed through well-known sulfurization techniques.

In one embodiment the salt of an aromatic compound may be obtained/obtainable by (i) reacting a polyhydroxy aromatic compound (e.g., optionally substituted catechol) with an epoxide, ether, or a poly(ether), optionally in the presence of a catalyst, to form a hydroxy-substituted intermediate compound according to Formula I, (ii) coupling the intermediate compound with sulfur, and (to form the salt) iii) reacting the sulfur-coupled intermediate compound with a metal base or pnictogen base.

i) Formation of Hydroxy-Substituted Intermediate Compound

The polyhydroxy aromatic compound of Formula I may be formed from a compound having the general formula:

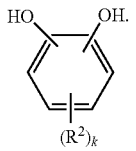

For example, the catecholate:

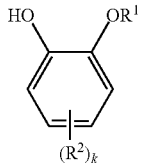

may be formed by reacting an optionally substituted catechol compound with an olefin, alkylene oxide (e.g., ethylene oxide, propylene oxide or butylene oxide), or poly(ether), optionally in the presence of a base catalyst. Typically the reaction occurs in the presence of a base catalyst.

The base catalyst may include sodium chloroacetate, sodium hydride sodium hydroxide, or potassium hydroxide.

When b=1, the alkoxy group may be formed by reacting the polyhydroxy aromatic compound with an epoxide, such as a cyclic ether or oxirane, with a hydroxyl group of the aromatic compound. The oxirane may be a 2-alkyloxirane having 8 to 24, or 12 to 18 carbon atoms. Examples of 2-alkyloxiranes include 2-octyloxirane, 2-nonyloxirane, 2-decyloxirane, 2-undecyloxirane, 2-dodecyloxirane, 2-tridecyloxirane, 2-tetradecyloxirane, 2-pentadecyloxirane, 2-hexadecyloxirane, 2-heptadecyloxirane, 2-octadecyloxirane, 2-nonadecyloxirane, 2-eicosyloxirane, and mixtures thereof.

When b=2 or more, the alkoxy group may be formed by reacting a polyether, or polyalkylene glycol with a hydroxyl group of the polyhydroxy aromatic compound. The polyether or polyalkylene glycol may be an ethylene, propylene, or butylene group, or mixture thereof, with the proviso that if $R^1$ comprises ethylene groups the resultant aromatic compound may be a random or block copolymer derived from ethylene glycol and either (i) propylene glycol or (ii) butylene glycol.

The process to prepare the intermediate may be carried out a reaction temperature of 70° C. to 175° C., or 90° C. to 160° C., or 95° C. to 150° C. The formation of the intermediate may be performed in the presence or absence of solvent. The solvent may include a hydrocarbon such as hexane, toluene, xylene, diluent oil, cyclohexane, or mixture thereof. In one embodiment the process to prepare the intermediate is performed in the presence of a solvent. Optionally the solvent is removed before sulfurizing and/or reacting of the intermediate with the metal base.

The reaction pressure will generally be atmospheric, although higher or lower pressures may be employed. The process of forming the intermediate can be practiced in a batchwise, continuous or semi-continuous manner.

In one embodiment, where the compound includes an $R^2$ group, the intermediate compound may be reacted with an alkylating agent selected from linear and branched olefins having from 2 to about 30 carbon atoms per molecule, optionally in the presence of a solid or liquid catalyst. Example catalysts include Lewis acid catalysts, solid acid catalysts, trifluoromethanesulfonic acid, and acidic molecular sieve catalysts. Suitable Lewis acid catalysts include aluminum trichloride, aluminum tribromide, aluminum triiodide, boron trifluoride, boron tribromide, boron triiodide and the like. Suitable solid acidic catalysts include zeolites, acid clays, and/or silica-alumina.

ii) Reacting the Intermediate Compound with Sulfur

Sulfurization may be performed by contacting the intermediate compound of Formula I with a sulfur source which introduces $S_x$ bridging groups between oxy-substituted aromatic polyols, wherein x may be 1 to 7, in the presence of a base. Any suitable sulfur source can be used such as, for example, elemental sulfur or a halide thereof such as sulfur monochloride, sulfur dichloride, hydrogen sulfide, sulfur dioxide, or a sodium sulfide hydrate. The sulfur can be employed either as molten sulfur or as a solid (e.g., powder or particulate) or as a solid suspension in a compatible hydrocarbon liquid. Suitable bases include NaOH, KOH, $Ca(OH)_2$, and mixtures thereof.

The base is generally employed at from about 0.01 to about 1 mole percent to the intermediate compound in the reaction system. The base can be added to the reaction mixture as a solid or a liquid. In one preferred embodiment, the base is added as an aqueous solution.

Sulfur may be employed at from 0.5 to 4 moles per mole of the intermediate compound in the reaction system. In one embodiment, sulfur is employed at from 0.8 to 2 moles per mole of the intermediate compound.

The temperature range in which the sulfurization reaction is carried out is generally 130-200° C., e.g., 150-180° C. The reaction can be conducted under atmospheric pressure (or slightly lower) or at elevated pressures. During sulfurization a significant amount of by-product hydrogen sulfide gas is evolved. In one embodiment the reaction is carried out under vacuum to facilitate the $H_2S$ elimination.

As an example, a sulfurized oxyalkylated-catechol is prepared by reaction of 2-((2-hydroxyhexadecyl)oxy)phenol with sulfur monochloride.

Other sulfurization techniques which may be adapted to use herein are described, for example, in U.S. Pat. No. 2,680,096, to Walker et al., issued Jun. 1, 1954; U.S. Pat. No. 3,372,116, to Meinhardt, issued Mar. 6, 1968; U.S. Pat. No. 3,036,971, to Otto, issued May 29, 1962, U.S. Pat. No. 7,435,709, to Stonebraker, et al., issued Oct. 14, 2008, U.S. Pat. No. 8,772,209 to Mahieux, et al., issued Jul. 8, 2014, U.S. Pat. No. 9,062,271 to Jukes, et al., issued Jun. 23, 2015, and U.S. Pub. No. U.S. Pub. No. 20150045269, published Feb. 12, 2015, to Walker, et al. The 20150045269 publication, for example, describes preparation of a sulfurized alkaline earth metal (e.g., calcium) dodecylphenate by reacting dodecylphenol with calcium hydroxide or calcium oxide and an alkylene glycol. The reaction product is reacted with sulfur.

iii) Formation of the Salt

Formation of the salt may be performed by reaction of the sulfurized oxy-hydrocarbyl substituted catecholate or other sulfurized intermediate compound with a metal base which serves as a cation source, such as lime (calcium hydroxide/oxide) or magnesium oxide, or with a pnictogen base, in approximately equimolar amounts, with respect to the residual OH groups in the intermediate compound, optionally in the presence of a solvent.

The sulfurized intermediate compound and the metal of the metal base may form a salt by interaction of a cation metal with an anion formed by either a —OH bonded directly to the aromatic group, or through a —OH group along an oxyalkylated group.

Suitable metal basic compounds include hydroxides, oxides or alkoxides of the metal such as (1) an alkali metal salt derived from a metal base selected from an alkali hydroxide, alkali oxide or an alkali alkoxide, or (2) an alkaline earth metal salt derived from a metal base selected from an alkaline earth hydroxide, alkaline earth oxide or alkaline earth alkoxide. Representative examples of metal basic compounds with hydroxide functionality include lithium hydroxide, potassium hydroxide, sodium hydroxide, magnesium hydroxide, calcium hydroxide, barium hydroxide, aluminum hydroxide and the like. Representative examples of metal basic compounds with oxide functionality include lithium oxide, magnesium oxide, calcium oxide, barium oxide and the like. In one embodiment, the alkaline earth metal base is slaked lime (calcium hydroxide).

The pnictogen cation may be derivable from a compound with a primary amine, a secondary amine, a tertiary amine, or mixtures thereof. Typically the amine salt may be derived from a secondary or a tertiary amine.

The amine that can be used to prepare a pnictogen is known to a skilled person and is intended to include an amine capable of salting with a protic acid.

The amine may be an alkyl amine, typically a di- or tri-alkyl amine. The alkyl amine may have alkyl groups having 1 to 30, or 2 to 20, or 3 to 10 carbon atoms. Examples of a dialkyl amine include diethylamine, dipropylamine, dibutylamine, dipentylamine, dihexylamine, di-(2-ethylhexyl)amine, di-decylamine, di-dodecylamine, di-stearylamine, di-oleylamine, di-eicosylamine, or mixtures thereof. Examples of a trialkyl amine include triethylamine, tripropylamine, tributylamine, tripentylamine, trihexylamine, tri-(2-ethylhexyl)amine, tri-decylamine, tridodecylamine, tri-stearylamine, tri-oleylamine, tri-eicosylamine, or mixtures thereof.

The amine may also be a tertiary-aliphatic primary amine. The aliphatic group in this case may be an alkyl group containing 2 to 30, or 6 to 26, or 8 to 24 carbon atoms. Tertiary alkyl amines include monoamines such as tert-butylamine, tert-hexylamine, 1-methyl-1-amino-cyclohexane, tert-octylamine, tert-decylamine, tert-dodecylamine, tert-tetradecylamine, tert-hexadecylamine, tert-octadecylamine, tert-tetracosanylamine, and tert-octacosanylamine.

In one embodiment the pnictogen base includes a phosphorus acid amine salt which includes an amine with $C_{11}$ to $C_{22}$ tertiary alkyl primary groups or mixtures thereof.

In one embodiment the amine salt may be in the form of a quaternary ammonium salt. Examples of quaternary ammonium salts containing a hydroxyalkyl group, and methods for their synthesis, are disclosed in U.S. Pat. No. 3,962,104. In certain embodiments, the quaternary ammonium compound is derived from a monoamine by means of alkylation, i.e., from a tertiary amine having only a single amino group, that is, having no additional amine nitrogen atoms in any of the three hydrocarbyl groups or substituted hydrocarbyl groups attached to the tertiary amine nitrogen. In certain embodiments there are no additional amine nitrogen atoms in any of the hydrocarbyl groups or substituted hydrocarbyl groups attached to the central nitrogen in the quaternary ammonium ion. The tetraalkylammonium hydroxide may contain alkyl groups having 1 to 30, or 2 to 20, or 3 to 10 carbon atoms. The tetraalkylammonium hydroxide may include tetrapropylammonium hydroxide, tetrabutylammonium hydroxide, tetrapentylammonium hydroxide, tetrahexylammonium hydroxide, tetra-2-ethylhexyl-ammonium hydroxide, tetradecylammonium hydroxide, or mixtures thereof.

The amine may be quaternized with a quaternizing agent, or mixture thereof.

The pnictogen base may further include aminoalkyl substituted heterocyclic compounds such as 1-(3-aminopropyl) imidazole and 4-(3-aminopropyl)morpholine, 1-(2-aminoethyl)piperidine, 3,3-diamino-N-methyldipropylamine, and 3,3-aminobis(N,N-dimethylpropylamine).

Other examples of quaternary ammonium salts and methods for preparing the same are described in U.S. Pat. Nos. 3,778,371, 4,171,959, 4,253,980, 4,326,973, 4,338,206, and 5,254,138.

When the amine salt is derived from an aromatic amine, the aromatic amine may form an ion such as a pyridinium ion, or an imidazolium ion. Certain quaternary phosphonium salts may be prepared by the reaction of phosphine with aldehydes and a halide e.g., tetrakis(hydroxymethyl)phosphonium halide (typically chloride).

A quaternary pnictogen halide compound may be a commercially available material, or it may be prepared by reaction of a tertiary amine with a hydrocarbyl halide, by known techniques. This reaction may be performed in a separate vessel or in the same vessel in which it is subsequently (or simultaneously) reacted with the oil-soluble acidic compound, which may be converted previously (or simultaneously) into its metal neutralized form.

Neutralization of the sulfurized intermediate compound may be carried out in a continuous or batch process by any method known to a person skilled in the art. In general, neutralization can be carried out by contacting the sulfurized or intermediate compound with a metal or pnictogen base under reactive conditions, e.g., in an inert-compatible liquid hydrocarbon diluent. If desired, the reaction can be conducted under an inert gas, such as nitrogen. The metal or pnictogen base may be added either in a single addition or in a plurality of additions at intermediate points during the reaction.

Neutralization may be conducted in a suitable solvent or diluent oil, such as toluene, xylene and commonly with a promoter such as an alcohol, e.g., a $C_1$ to $C_{16}$ alcohol, such as methanol, decyl alcohol, or 2-ethylhexanol; a diol, e.g., $C_2$ to $C_4$ alkylene glycols, such as ethylene glycol; and/or carboxylic acids. Suitable diluent oils include naphthenic oils and mixed oils, e.g., paraffinic. The quantity of solvent or diluent oil used may be such that the amount of solvent or oil in the final product constitutes from 15% to 65% by weight of the final product, such as from about 25% to 50%.

The neutralization reaction may be conducted at temperatures above room temperature (20° C.). In general, neutralization can be carried out at a temperature of between 100-150° C. The neutralization reaction itself may take place for over 5 to 60 minutes.

In another embodiment, the salt of the sulfurized oxy-substituted aromatic compound can be prepared in a one-pot method. In this method, the compound of Formula I (e.g., 2-((2-Hydroxyhexadecyl)oxy)phenol) is combined with diluent oil and ethylene glycol and heated while stirring. A metal or pnictogen base, such as hydrated lime, is added to the heated reaction mixture, e.g., in several portions. Sulfur is added to the reaction mixture, and optionally additional metal or pnictogen base is added and the mixture stirred. The reaction mixture may be vacuum stripped to remove excess solvent.

In one embodiment, the exemplary sulfurized oxy-substituted aromatic polyol salt (e.g., sulfur-coupled oxyhydrocarbyl catecholate salt) may be overbased. Overbasing can be carried out either during or after one of the sulfurization and/or neutralization steps. Alternatively, sulfurization, neutralization and overbasing can be carried out simultaneously. In general, the overbasing is carried out by reaction of the salt of the sulfur-coupled oxy-substituted aromatic polyol with an acidic overbasing compound, such as carbon dioxide or boric acid. In one embodiment, an overbasing process is by way of carbonation, i.e., a reaction with carbon dioxide. Such carbonation can be conveniently effected by addition of solvents such as aromatic solvents, alcohols or a polyols, typically an alkylene diol, e.g., ethylene glycol. Conveniently, the reaction is conducted by the simple expedient bubbling of gaseous carbon dioxide through the reaction mixture, optionally in the presence of sulfonic acid. Excess solvents and any water formed during the overbasing reaction can be conveniently removed by distillation either during or after the reaction.

In one embodiment, the overbasing reaction is carried out in a reactor by reacting the salt of the sulfurized alkyl-substituted hydroxyaromatic composition with a source of an alkaline earth metal such as lime (i.e., an alkaline earth metal hydroxide) in the presence of carbon dioxide, and in the presence of an aromatic solvent (e.g., xylene), and a hydrocarbyl alcohol such as methanol. Conveniently, the reaction is conducted by the simple expedient of bubbling gaseous carbon dioxide through the reaction mixture. The carbon dioxide is introduced over a period of 1 hour to 3 hours, at a temperature ranging from 150-200° C. The degree of overbasing may be controlled by the quantity of the source of an alkaline earth metal, carbon dioxide and the reactants added to the reaction mixture and the reaction conditions used during the carbonation process.

In another embodiment, the overbasing reaction can be carried out at from 140-180° C. in the presence of a polyol, typically an alkylene diol, e.g., ethylene glycol, and/or alkanols, e.g., $C_6$ to $C_{16}$ alkanol(s), such as decyl alcohols or 2-ethyl hexanol. Excess solvent and any water formed during the overbasing reaction can be conveniently removed by distillation either during or after the reaction.

Methods for forming overbased detergents useful herein are described, for example, in U.S. Pat. Nos. 5,259,966, 6,015,778, 5,534,168, and 6,268,318, and U.S. Pub. No. 2013/0203639.

The resulting overbased salt of the sulfurized hydroxy-substituted intermediate compound may contain some amount, by combined, mass, of unsulfurized hydroxy-substituted intermediate compound and/or its unsulfurized metal salt.

The composition containing the overbased salt of the sulfurized hydroxy-substituted intermediate compound may be sparged, e.g., by bubbling air at a temperature ranging from 190-250° C. through the composition. The sparging results in removing substantially all of the unsulfurized hydroxy-substituted intermediate compound and salts thereof to provide a composition substantially free of the unsulfurized hydroxy-substituted intermediate compound and unsulfurized salts thereof. The term "substantially free" as used herein means less than 1.5 wt. %, or less than 1 wt. %, or less than 0.3 wt. % of these unsulfurized compounds, such as 0.1-0.3 wt. %, or less.

In one embodiment, the salt of the sulfur-coupled oxy-substituted aromatic polyol does not contain any sulfonate functional groups.

In one embodiment, the salt of the sulfur-coupled oxy-substituted aromatic polyol does not contain any phosphate functional groups.

In one embodiment, the salt of the sulfur-coupled oxy-substituted aromatic polyol does not contain any borate functional groups.

In another embodiment, the salt of the sulfur-coupled oxy-substituted aromatic polyol does contain a borate functional group.

The salts described above can be boronated by processes know to those skilled in the art. Boration can be accomplished either prior to, or after, the overbasing step. The boration can be accomplished by a number of boronating agents, such as boric acid, metaboric acid, orthoboric acid, alkyl borates, boron halides, polymers of boron, esters of boron and similar materials. When present, the boron content of the salt may be 0.1 wt. % to 5 wt. %, or 1 wt. % to 5 wt. %, or 2 wt. % to 4 wt. %.

The salt of the aromatic compound of the disclosed technology in one embodiment may be formed from an anion composed of carbon, hydrogen, oxygen, boron and nitrogen; and a metallic cation.

In one embodiment, the salt of the sulfur-coupled oxy-substituted aromatic polyol may comprise or consist of an anion composed of carbon, hydrogen, oxygen and optionally nitrogen; and a metallic cation, such as a calcium, magnesium or sodium cation.

Lubricating Composition

The oxy-substituted aromatic polyol or salt thereof may be present in the lubricating composition at a concentration of at least 0.1 wt. % and may be up to 20 wt. %. For example, the concentration of the compound may be at least 0.2 wt. %, or at least 0.3 wt. %, or at least 0.4 wt. %, or at least 0.5 wt. %, or at least 1 wt. %, of the lubricating composition. The concentration of the compound may be up to 10 wt. %, or up to 5 wt. %, or up to 2 wt. %, or up to 1 wt. %, of the lubricating composition. The compound may also be present in a concentrate, alone or with other additives and with a lesser amount of oil. In a concentrate, the amount of the compound may be at least 2, or at least 3 times the concentration in the lubricating composition.

In addition to the oxy-substituted aromatic polyol compound, the exemplary lubricating composition includes an oil of lubricating viscosity and optionally one or more additional performance additives suited to providing the performance properties of a fully formulated lubricating composition, e.g., a marine diesel cylinder lubricant.

The amount of the oil of lubricating viscosity present may be typically the balance remaining after subtracting from 100 wt. %, the sum of the amount of the compound as described herein, and any other performance additives. The lubricating composition may include the oil of lubricating viscosity as a minor or major component thereof, such as at least 5 wt. %, or at least 10 wt. %, or at least 20 wt. %, or at least 30 wt. %, or at least 40 wt. %, or at least 60 wt. %, or at least 80 wt. % of the lubricating composition.

Examples of these additional performance additives include (overbased) detergents, viscosity modifiers, friction modifiers, antioxidants, dispersants, antiwear/antiscuffing agents, metal deactivators, extreme pressure agents, foam inhibitors, demulsifiers, pour point depressants, corrosion inhibitors, seal swelling agents, and the like, which may be used singly or in combination.

The lubricating composition comprising may have a kinematic viscosity of 2 cSt to 20 cSt at 100° C., as measured by ASTM D445-14, "Standard Test Method for Kinematic Viscosity of Transparent and Opaque Liquids (and Calculation of Dynamic Viscosity)," ASTM International, West Conshohocken, Pa., 2003, DOI: 10.1520/D0445-14. The lubricating composition is liquid, i.e., not a gel or semi-solid, at ambient temperatures (5-30° C.).

In one embodiment the lubricating composition is not an aqueous composition.

A. Oil of Lubricating Viscosity

Suitable oils include natural and synthetic oils, oil derived from hydrocracking, hydrogenation, and hydrofinishing, unrefined, refined, re-refined oils or mixtures thereof. Unrefined, refined and re-refined oils, and natural and synthetic oils are described, for example, in WO 2008/147704 and US Pub. No. 2010/197536. Synthetic oils may also be produced by Fischer-Tropsch reactions and typically may be hydroisomerized Fischer-Tropsch hydrocarbons or waxes. Oils may be prepared by a Fischer-Tropsch gas-to-liquid synthetic procedure as well as other gas-to-liquid procedures.

Oils of lubricating viscosity may also be defined as specified in April 2008 version of "Appendix E—API Base Oil Interchangeability Guidelines for Passenger Car Motor Oils and Diesel Engine Oils", section 1.3 Sub-heading 1.3. "Base Stock Categories". The API Guidelines are also summarized in U.S. Pat. No. 7,285,516. The five base oil groups are as follows: Group I (sulfur content >0.03 wt. %, and/or <90 wt. % saturates, viscosity index 80-120); Group II (sulfur content <0.03 wt. %, and >90 wt. % saturates, viscosity index 80-120); Group III (sulfur content <0.03 wt. %, and >90 wt. % saturates, viscosity index >120); Group IV (all polyalphaolefins (PAOs)); and Group V (all others not included in Groups I, II, III, or IV). The exemplary oil of lubricating viscosity includes an API Group I, Group II, Group III, Group IV, Group V oil, or mixtures thereof. In some embodiments, the oil of lubricating viscosity is an API Group I, Group II, Group III, or Group IV oil, or mixtures thereof. In some embodiments, the oil of lubricating viscosity is an API Group I, Group II, or Group III oil, or mixture thereof. In one embodiment the oil of lubricating viscosity may be an API Group II, Group III mineral oil, a Group IV synthetic oil, or mixture thereof. In some embodiments, at least 5 wt. %, or at least 10 wt. %, or at least 20 wt. %, or at least 40 wt. % of the lubricating composition is a polyalphaolefin (Group IV).

The lubricating composition disclosed herein may have a SAE viscosity grade of XW-Y, wherein X may be 0, 5, 10 or 15; and Y may be 16, 20, 30 or 40.

The oil of lubricating viscosity may have a kinematic viscosity of up to 30 $mm^2/s$ or up to 25 $mm^2/s$ (cSt) at 100° C. and can be at least 12 $mm^2/s$ at 100° C., and in other embodiments at least 15 $mm^2/s$. As used herein, kinematic viscosity is determined at 100° C. by ASTM D445-14, "Standard Test Method for Kinematic Viscosity of Transparent and Opaque Liquids (and Calculation of Dynamic Viscosity)," ASTM International, West Conshohocken, Pa., 2003, DOI: 10.1520/D0445-14 and may be referred to as KV_100.

The viscosity grade of cylinder oils suited to use in 2-stroke marine diesel engines may be from SAE-40 to SAE-60, which corresponds to a KV_100 of 12.5 to 26 $mm^2/s$. SAE-50 grade oils, for example, have a KV_100 of 16.3-21.9 $mm^2/s$. Cylinder oils for 2-stroke marine diesel engines may be formulated to achieve a KV_100 of 19 to 21.5 $mm^2/s$. This viscosity can be obtained by a mixture of additives and base oils, for example containing mineral bases of Group I such as Neutral Solvent (for example 500 NS or 600 NS) and Bright Stock bases. Any other combination of mineral or synthetic bases or bases of vegetable origin having, in mixture with the additives, a viscosity compatible with the grade SAE 50 can be used.

As an example, an oil formulation suited to use as a cylinder lubricant for low-speed 2-stroke marine diesel engines contains 18 to 25 wt. % of a Group I base oil of a BSS type (distillation residue, with a KV_100 of 28-32 $mm^2/s$, with a density at 15° C. of 895-915 $kg/m^3$), and 50 to 60 wt. % of a Group I base oil of a SN 600 type (distillate, with a density at 15° C. of 880-900 $kg/m^3$, with a KV_100 of 12 $mm^2/s$).

In certain embodiments, the lubricating composition may contain synthetic ester base fluids. Synthetic esters may have a kinematic viscosity measured at 100° C. of 2.5 $mm^2/s$ to 30 $mm^2/s$. In one embodiment, the lubricating composition comprises less than 50 wt. % of a synthetic ester base fluid with a KV_100 of at least 5.5 $mm^2/s$, or at least 6 $mm^2/s$, or at least 8 $mm^2/s$.

Exemplary synthetic oils include poly-alpha olefins, polyesters, polyacrylates, and poly-methacrylates, and co-polymers thereof. Example synthetic esters include esters of a dicarboxylic acid (e.g., selected from phthalic acid, succinic acid, alkyl succinic acids, alkenyl succinic acids, maleic acid, azelaic acid, suberic acid, sebacic acid, fumaric acid, adipic acid, linoleic acid dimer, malonic acid, alkyl malonic acids, and alkenyl malonic acids) with an alcohol (e.g., selected from butyl alcohol, hexyl alcohol, dodecyl alcohol, 2-ethylhexyl alcohol, ethylene glycol, diethylene glycol monoether, and propylene glycol). Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid.

Esters useful as synthetic oils also include those made from $C_5$ to $C_{12}$ monocarboxylic acids and polyols and from polyol ethers such as neopentyl glycol, trimethylolpropane, pentaerythritol, dipentaerythritol, and tripentaerythritol. Esters can also be monoesters, such as are available under the trade name Priolube 1976™ ($C_{18}$-alkyl-COO—$C_{20}$ alkyl).

Synthetic ester base oils may be present in the lubricating composition of the invention in an amount less than 50 wt. % of the composition, or less than 40 weight %, or less than 35 weight %, or less than 28 weight %, or less than 21 weight %, or less than 17 weight %, or less than 10 weight %, or less than 5 weight % of the composition. In one embodiment, the lubricating composition of the invention is free of, or substantially free of, a synthetic ester base fluid having a KV_100 of at least 5.5 $mm^2/s$.

Example natural oils include animal and vegetable oils, such as long chain fatty acid esters. Examples include linseed oil, sunflower oil, sesame seed oil, beef tallow oil, lard oil, palm oil, castor oil, cottonseed oil, corn oil, peanut oil, soybean oil, olive oil, whale oil, menhaden oil, sardine oil, coconut oil, palm kernel oil, babassu oil, rapeseed oil, and soya oil.

The amount of the oil of lubricating viscosity present is typically the balance remaining after subtracting from 100 weight % the sum of the amount of the exemplary aminocarboxylate compound and the other performance additives.

Method of Forming the Lubricating Composition

A lubricating composition may be prepared by combining the sulfur-coupled oxyhydrocarbyl catecholate compound or salt thereof with an oil of lubricating viscosity, optionally in the presence of other performance additives (as described herein below), or by adding reagents for forming the salt compound to an oil of lubricating viscosity.

The lubricating composition may further include additional performance additives, such as detergents, antioxidants, additional dispersants, antiwear agents, and friction modifiers.

In one embodiment, the lubricating composition is free of branched para-$C_{10-20}$-alkylphenols, including p-dodecylphenol (PDDP). By "free" it is meant that the composition contains, in total, less than 0.001%, or less than 0.0001% para-$C_{10-20}$-alkylphenols.

Other Performance Additives

In addition to the exemplary oxy-hydrocarbyl substituted catecholate compound(s) disclosed herein, the lubricating composition may further include one or more of the following additional performance additives: detergents, antioxidants, dispersants, viscosity modifiers, antiwear/antiscuffing agents, metal deactivators, friction modifiers, extreme pressure agents, foam inhibitors, demulsifiers, pour point depressants, corrosion inhibitors, seal swelling agents, and the like.

A. Detergents

The lubricating composition optionally further includes at least one detergent. Exemplary detergents useful herein include overbased metal-containing detergents. The metal of the metal-containing detergent may be zinc, sodium, calcium, barium, or magnesium. The overbased metal-containing detergent may be chosen from sulfonates, non-sulfur containing phenates, sulfur containing phenates, salixarates, salicylates, and mixtures thereof, or borated equivalents thereof. The overbased detergent may be borated with a borating agent such as boric acid.

The overbased metal-containing detergent may also include "hybrid" detergents formed with mixed surfactant systems including phenate and/or sulfonate components, e.g., phenate/salicylates, sulfonate/phenates, sulfonate/salicylates, sulfonates/phenates/salicylates, as described, for example, in U.S. Pat. Nos. 6,429,178; 6,429,179; 6,153,565; and 6,281,179. Where a hybrid sulfonate/phenate detergent is employed, the hybrid detergent can be considered equivalent to amounts of distinct phenate and sulfonate detergents introducing like amounts of phenate and sulfonate soaps, respectively.

Example overbased metal-containing detergents include zinc, sodium, calcium and magnesium salts of sulfonates, phenates (including sulfur-containing and non-sulfur containing phenates), salixarates and salicylates. Such overbased sulfonates, salixarates, phenates and salicylates may have a total base number of 120 to 700, or 250 to 600, or 300 to 500 (on an oil free basis).

Typically, an overbased metal-containing detergent may be a zinc, sodium, calcium or magnesium salt of a sulfonate, a phenate, sulfur containing phenate, salixarate or salicylate. Overbased sulfonates, salixarates, phenates and salicylates typically have a total base number of 120 to 700 TBN. Overbased sulfonates typically have a total base number of 120 to 700, or 250 to 600, or 300 to 500 (on an oil free basis).

The overbased sulfonate detergent may have a metal ratio of 12 to less than 20, or 12 to 18, or 20 to 30, or 22 to 25.

Example sulfonate detergents include linear and branched alkylbenzene sulfonate detergents, and mixtures thereof, which may have a metal ratio of at least 8, as described, for example, in U.S. Pub. No. 2005065045. Linear alkyl benzenes may have the benzene ring attached anywhere on the linear chain, usually at the 2, 3, or 4 position, or be mixtures thereof. Linear alkylbenzene sulfonate detergents may be particularly useful for assisting in improving fuel economy.

In one embodiment, the alkylbenzene sulfonate detergent may be a branched alkylbenzene sulfonate, a linear alkylbenzene sulfonate, or mixtures thereof.

In one embodiment, the lubricating composition may be free of linear alkylbenzene sulfonate detergent. The sulfonate detergent may be a metal salt of one or more oil-soluble alkyl toluene sulfonate compounds as disclosed in U.S. Pub. No. 20080119378.

The lubricating composition may include at least 0.01 wt. % or at least 0.1 wt. %, detergent, and in some embodiments, up to 2 wt. %, or up to 1 wt. % detergent.

B. Antioxidants

The lubricating composition optionally further includes at least one antioxidant. Exemplary antioxidants useful herein include phenolic and aminic antioxidants, such as diarylamines, alkylated diarylamines, hindered phenols, and mixtures thereof. The diarylamine or alkylated diarylamine may be a phenyl-α-naphthylamine (PANA), an alkylated diphenylamine, an alkylated phenylnapthylamine, or mixture thereof. Example alkylated diphenylamines include dinonyl diphenylamine, nonyl diphenylamine, octyl diphenylamine, dioctyl diphenylamine, didecyl diphenylamine, decyl diphenylamine, and mixtures thereof. Example alkylated diarylamines include octyl, dioctyl, nonyl, dinonyl, decyl and didecyl phenylnapthylamines. Hindered phenol antioxidants often contain a secondary butyl and/or a tertiary butyl group as a steric hindering group. The phenol group may be further substituted with a hydrocarbyl group (e.g., a linear or branched alkyl) and/or a bridging group linking to a second aromatic group. Examples of suitable hindered phenol antioxidants include 2,6-di-tert-butylphenol, 4-methyl-2,6-di-tert-butylphenol, 4-ethyl-2,6-di-tert-butylphenol, 4-propyl-2,6-di-tert-butylphenol, 4-butyl-2,6-di-tert-butylphenol, and 4-dodecyl-2,6-di-tert-butylphenol. In one embodiment, the hindered phenol antioxidant may be an ester, such as those described in U.S. Pat. No. 6,559,105. One such hindered phenol ester is sold as Irganox™ L-135, obtainable from Ciba.

When present, the lubricating composition may include at least 0.1 wt. % or at least 0.5 wt. %, or at least 1 wt. % antioxidant, and in some embodiments, up to 3 wt. %, or up to 2.75 wt. %, or up to 2.5 wt. % antioxidant.

C. Dispersants

The lubricating composition optionally further includes at least one dispersant other than the exemplary compound. Exemplary dispersants include succinimide dispersants, Mannich dispersants, succinamide dispersants, and polyolefin succinic acid esters, amides, and ester-amides, and mixtures thereof. The succinimide dispersant, where present, may be as described above for the succinimides described as useful for cation M.

The succinimide dispersant may be derived from an aliphatic polyamine, or mixtures thereof. The aliphatic polyamine may be an ethylenepolyamine, a propylenepolyamine, a butylenepolyamine, or a mixture thereof. In one embodiment the aliphatic polyamine may be an ethylenepolyamine. In one embodiment the aliphatic polyamine may be chosen from ethylenediamine, diethylenetriamine, triethylenetetramine, tetraethylenepentamine, pentaethylenehexamine, polyamine still bottoms, and mixtures thereof.

In one embodiment the dispersant may be a polyolefin succinic acid ester, amide, or ester-amide. A polyolefin succinic acid ester-amide may be a polyisobutylene succinic acid reacted with an alcohol (such as pentaerythritol) and a polyamine as described above. Example polyolefin succinic acid esters include polyisobutylene succinic acid esters of pentaerythritol and mixture thereof.

The dispersant may be an N-substituted long chain alkenyl succinimide. An example of an N-substituted long chain alkenyl succinimide is polyisobutylene succinimide. Typically the polyisobutylene from which polyisobutylene succinic anhydride is derived has a number average molecular weight of 350 to 5000, or 550 to 3000 or 750 to 2500. Succinimide dispersants and their preparation are disclosed, for example, in U.S. Pat. Nos. 3,172,892, 3,219,666, 3,316,177, 3,340,281, 3,351,552, 3,381,022, 3,433,744, 3,444,170, 3,467,668, 3,501,405, 3,542,680, 3,576,743, 3,632,511, 4,234,435, Re 26,433, and 6,165,235, and 7,238,650 and EP Patent Application 0 355 895 A.

The succinimide dispersant may comprise a polyisobutylene succinimide, wherein the polyisobutylene from which polyisobutylene succinimide is derived has a number average molecular weight of 350 to 5000, or 750 to 2500.

The exemplary dispersants may also be post-treated by conventional methods by a reaction with any of a variety of agents. Among these are boron compounds (such as boric acid), urea, thiourea, dimercaptothiadiazoles, carbon disulfide, aldehydes, ketones, carboxylic acids, such as terephthalic acid, hydrocarbon-substituted succinic anhydrides, maleic anhydride, nitriles, epoxides, and phosphorus compounds. In one embodiment the post-treated dispersant is borated. In one embodiment the post-treated dispersant is reacted with dimercaptothiadiazoles. In one embodiment the post-treated dispersant is reacted with phosphoric or phosphorous acid. In one embodiment the post-treated dispersant is reacted with terephthalic acid and boric acid (as described in U.S. Pub. No. 2009/0054278.

When present, the lubricating composition may include at least 0.01 wt. %, or at least 0.1 wt. %, or at least 0.5 wt. %, or at least 1 wt. % dispersant, and in some embodiments, up to 20 wt. %, or up to 15 wt. %, or up to 10 wt. %, or up to 6 wt. % or up to 3 wt. % dispersant.

D. Anti-Wear Agents

The lubricating composition optionally further includes at least one antiwear agent. Examples of suitable antiwear agents suitable for use herein include titanium compounds, tartrates, tartrimides, oil soluble amine salts of phosphorus compounds, sulfurized olefins, metal dihydrocarbyldithiophosphates (such as zinc dialkyldithiophosphates), phosphites (such as dibutyl phosphite), phosphonates, thiocarbamate-containing compounds, such as thiocarbamate esters, thiocarbamate amides, thiocarbamic ethers, alkylene-coupled thiocarbamates, and bis(S-alkyldithiocarbamyl) disulfides. The antiwear agent may in one embodiment include a tartrate, or tartrimide as described in U.S. Pub. Nos. 2006/0079413; 2006/0183647; and 2010/0081592. The tartrate or tartrimide may contain alkyl-ester groups, where the sum of carbon atoms on the alkyl groups is at least 8. The antiwear agent may, in one embodiment, include a citrate as is disclosed in US Pub. No. 20050198894.

The lubricating composition may in one embodiment further include a phosphorus-containing antiwear agent. Example phosphorus-containing antiwear agents include zinc dialkyldithiophosphates, phosphites, phosphates, phosphonates, and ammonium phosphate salts, and mixtures thereof.

When present, the lubricating composition may include at least 0.01 wt. %, or at least 0.1 wt. %, or at least 0.5 wt. % antiwear agent, and in some embodiments, up to 3 wt. %, or up to 1.5 wt. %, or up to 0.9 wt. antiwear agent.

E. Oil Soluble Titanium Compounds

The lubricating composition may include one or more oil-soluble titanium compounds, which may function as antiwear agents, friction modifiers, antioxidants, deposit control additives, or more than one of these functions. Example oil-soluble titanium compounds are disclosed in U.S. Pat. No. 7,727,943 and U.S. Pub. No. 2006/0014651. Example oil soluble titanium compounds include titanium (IV) alkoxides, such as titanium (IV) isopropoxide and titanium (IV) 2-ethylhexoxide. Such alkoxides may be formed from a monohydric alcohol, a vicinal 1,2-diol, a polyol, or mixture thereof. The monohydric alkoxides may have 2 to 16, or 3 to 10 carbon atoms. In one embodiment, the titanium compound comprises the alkoxide of a vicinal 1,2-diol or polyol. 1,2-vicinal diols include fatty acid monoesters of glycerol, where the fatty acid may be, for example, oleic acid. Other example oil soluble titanium compounds include titanium carboxylates, such as titanium neodecanoate.

When present in the lubricating composition, the amount of oil-soluble titanium compounds is included as part of the antiwear agent.

F. Extreme Pressure (EP) Agents

The lubricating composition may include an extreme pressure agent. Example extreme pressure agents that are soluble in the oil include sulfur- and chlorosulfur-containing EP agents, dimercaptothiadiazole or $CS_2$ derivatives of dispersants (typically succinimide dispersants), derivative of chlorinated hydrocarbon EP agents and phosphorus EP agents. Examples of such EP agents include chlorinated wax; sulfurized olefins (such as sulfurized isobutylene), hydrocarbyl-substituted 2,5-dimercapto-1,3,4-thiadiazoles and oligomers thereof, organic sulfides and polysulfides, such as dibenzyl disulfide, bis-(chlorobenzyl) disulfide, dibutyl tetrasulfide, sulfurized methyl ester of oleic acid, sulfurized alkylphenol, sulfurized dipentene, sulfurized terpene, and sulfurized Diels-Alder adducts; phosphosulfurized hydrocarbons such as the reaction product of phosphorus sulfide with turpentine or methyl oleate; phosphorus esters, such as dihydrocarbon and trihydrocarbon phosphites, e.g., dibutyl phosphite, diheptyl phosphite, dicyclohexyl phosphite, pentylphenyl phosphite; dipentylphenyl phosphite, tridecyl phosphite, distearyl phosphite and polypropylene substituted phenol phosphite; metal thiocarbamates, such as zinc dioctyldithiocarbamate and barium heptylphenol diacid; amine salts of alkyl and dialkylphosphoric acids or derivatives including, for example, the amine salt of a reaction product of a dialkyldithiophosphoric acid with propylene oxide and subsequently followed by a further reaction with $P_2O_5$; and mixtures thereof. Some useful extreme pressure agents are described in U.S. Pat. No. 3,197,405.

When present, the lubricating composition may include at least 0.01 wt. %, or at least 0.1 wt. %, or at least 0.5 wt. % extreme pressure agent, and in some embodiments, up to 3 wt. %, or up to 1.5 wt. %, or up to 0.9 wt. % of the extreme pressure agent.

G. Foam Inhibitors

The lubricating composition may include a foam inhibitor. Foam inhibitors that may be useful in the lubricant composition include polysiloxanes; copolymers of ethyl acrylate and 2-ethylhexylacrylate and optionally vinyl acetate; demulsifiers including fluorinated polysiloxanes, trialkyl phosphates, polyethylene glycols, polyethylene oxides, polypropylene oxides and (ethylene oxide-propylene oxide) polymers.

H. Viscosity Modifiers

The lubricating composition may include a viscosity modifier. Viscosity modifiers (also sometimes referred to as viscosity index improvers or viscosity improvers) useful in the lubricant composition are usually polymers, including polyisobutenes, polymethacrylates (PMA) and polymethacrylic acid esters, diene polymers, polyalkylstyrenes, esterified styrene-maleic anhydride copolymers, hydrogenated alkenylarene-conjugated diene copolymers and polyolefins also referred to as olefin copolymer or OCP. PMAs are prepared from mixtures of methacrylate monomers having different alkyl groups. The alkyl groups may be either straight chain or branched chain groups containing from 1 to 18 carbon atoms. Most PMAs are viscosity modifiers as well as pour point depressants. In one embodiment, the viscosity modifier is a polyolefin comprising ethylene and one or more higher olefin, such as propylene.

When present, the lubricating composition may include at least 0.01 wt. %, or at least 0.1 wt. %, or at least 0.3 wt. %, or at least 0.5 wt. % polymeric viscosity modifiers, and in some embodiments, up to 10 wt. %, or up to 5 wt. %, or up to 2.5 wt. % polymeric viscosity modifiers.

I. Corrosion Inhibitors and Metal Deactivators

The lubricating composition may include a corrosion inhibitor. Corrosion inhibitors/metal deactivators that may be useful in the exemplary lubricating composition include fatty amines, octylamine octanoate, condensation products of dodecenyl succinic acid or anhydride, and a fatty acid such as oleic acid with a polyamine, derivatives of benzotriazoles (e.g., tolyltriazole), 1,2,4-triazoles, benzimidazoles, 2-alkyldithiobenzimidazoles and 2-alkyldithiobenzothiazoles.

J. Pour Point Depressants

The lubricating composition may include a pour point depressant. Pour point depressants that may be useful in the exemplary lubricating composition include polyalphaolefins, esters of maleic anhydride-styrene copolymers, polymethacrylates, polyacrylates, and polyacrylamides.

K. Friction Modifiers

The lubricating composition may include a friction modifier. Friction modifiers that may be useful in the exemplary lubricating composition include fatty acid derivatives such as amines, esters, epoxides, fatty imidazolines, condensation products of carboxylic acids and polyalkylene-polyamines and amine salts of alkylphosphoric acids. The friction modifier may be an ash-free friction modifier. Such friction modifiers are those which typically not produce any sulfated ash when subjected to the conditions of ASTM D 874. An additive is referred to as "non-metal containing" if it does not contribute metal content to the lubricant composition. As used herein the term "fatty alkyl" or "fatty" in relation to friction modifiers means a carbon chain having 8 to 30 carbon atoms, typically a straight carbon chain.

In one embodiment, the ash-free friction modifier may be represented by the formula:

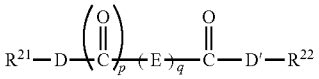

where D and D' are independently selected from —O—, >NH, >$NR^{23}$, an imide group formed by taking together both D and D" groups and forming a $R^{21}$—N<group between two >C═O groups; E is selected from —$R^{24}$—O—$R^{25}$—, >$CH_2$, >$CHR^{26}$, >$CR^{26}R^{27}$, >C(OH)($CO_2R^{22}$), >C($CO_2R^{22}$)$_2$, and >$CHOR^{28}$; where $R^{24}$ and $R^{25}$ are independently selected from >$CH_2$, >$CHR^{26}$, >$CR^{26}R^{27}$, >C(OH)($CO_2R^{22}$), and >$CHOR^{28}$; q is 0 to 10, with the proviso that when q=1, E is not >$CH_2$, and when n=2, both Es are not >$CH_2$; p is 0 or 1; $R^{21}$ is independently hydrogen or a hydrocarbyl group, typically containing 1 to 150 carbon atoms, with the proviso that when $R^{21}$ is hydrogen, p is 0, and q is more than or equal to 1; $R^{22}$ is a hydrocarbyl group, typically containing 1 to 150 carbon atoms; $R^{23}$, $R^{24}$, $R^{25}$, $R^{26}$ and $R^{27}$ are independently hydrocarbyl groups; and $R^{28}$ is hydrogen or a hydrocarbyl group, containing 1 to 150 carbon atoms, or 4 to 32 carbon atoms, or 8 to 24 carbon atoms. In certain embodiments, the hydrocarbyl groups $R^{23}$, $R^{24}$, and $R^{25}$, may be linear or predominantly linear alkyl groups.

In certain embodiments, the ash-free friction modifier is a fatty ester, amide, or imide of various hydroxy-carboxylic acids, such as tartaric acid, malic acid lactic acid, glycolic acid, and mandelic acid. Examples of suitable materials include tartaric acid di(2-ethylhexyl) ester (i.e., di(2-ethylhexyl)tartrate), di($C_8$-$C_{10}$) tartrate, di($C_{12-15}$) tartrate, dioleyl tartrate, oleyl tartrimide, and oleyl maleimide.

In certain embodiments, the ash-free friction modifier may be chosen from long chain fatty acid derivatives of amines, fatty esters, or fatty epoxides; fatty imidazolines such as condensation products of carboxylic acids and polyalkylene-polyamines; amine salts of alkylphosphoric acids; fatty alkyl tartrates; fatty alkyl tartrimides; fatty alkyl tartramides; fatty phosphonates; fatty phosphites; borated phospholipids, borated fatty epoxides; glycerol esters; borated glycerol esters; fatty amines; alkoxylated fatty amines; borated alkoxylated fatty amines; hydroxyl and polyhydroxy fatty amines including tertiary hydroxy fatty amines; hydroxy alkyl amides; metal salts of fatty acids; metal salts of alkyl salicylates; fatty oxazolines; fatty ethoxylated alcohols; condensation products of carboxylic acids and polyalkylene polyamines; or reaction products from fatty carboxylic acids with guanidine, aminoguanidine, urea, or thiourea and salts thereof.

Friction modifiers may also encompass materials such as sulfurized fatty compounds and olefins, sunflower oil or soybean oil monoester of a polyol and an aliphatic carboxylic acid.

In another embodiment the friction modifier may be a long chain fatty acid ester. In another embodiment the long chain fatty acid ester may be a mono-ester and in another embodiment the long chain fatty acid ester may be a triglyceride.

The amount of the ash-free friction modifier in a lubricant may be 0.1 to 3 wt. % (or 0.12 to 1.2 or 0.15 to 0.8 wt. %). The material may also be present in a concentrate, alone or with other additives and with a lesser amount of oil. In a concentrate, the amount of material may be two to ten times the above concentration amounts.

Molybdenum compounds are also known as friction modifiers. The exemplary molybdenum compound does not contain dithiocarbamate moieties or ligands.

Nitrogen-containing molybdenum materials include molybdenum-amine compounds, as described in U.S. Pat. No. 6,329,327, and organomolybdenum compounds made from the reaction of a molybdenum source, fatty oil, and a diamine as described in U.S. Pat. No. 6,914,037. Other molybdenum compounds are disclosed in U.S. Pub. No. 20080280795. Molybdenum amine compounds may be obtained by reacting a compound containing a hexavalent molybdenum atom with a primary, secondary or tertiary amine represented by the formula $NR^{29}R^{30}R^{31}$, where each of $R^{29}$, $R^{30}$ and $R^{31}$ is independently hydrogen or a hydrocarbyl group of 1 to 32 carbon atoms and wherein at least one of $R^{29}$, $R^{30}$ and $R^{31}$ is a hydrocarbyl group of 4 or more carbon atoms or represented by the formula:

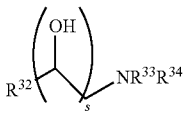

where $R^{32}$ represents a chain hydrocarbyl group having 10 or more carbon atoms, s is 0 or 1, $R^{33}$ and/or $R^{34}$ represents a hydrogen atom, a hydrocarbyl group, an alkanol group or an alkyl amino group having 2 to 4 carbon atoms, and when s=0, both $R^{33}$ and $R^{34}$ are not hydrogen atoms or hydrocarbon groups.

Specific examples of suitable amines include monoalkyl (or alkenyl) amines such as tetradecylamine, stearylamine, oleylamine, beef tallow alkylamine, hardened beef tallow alkylamine, and soybean oil alkylamine; dialkyl(or alkenyl) amines such as N-tetradecylmethylamine, N-pentadecylmethylamine, N-hexadecylmethylamine, N-stearylmethylamine, N-oleylmethylamine, N-cocoylmethylamine, N-beef tallow alkyl methylamine, N-hardened beef tallow alkyl methylamine, N-soybean oil alkyl methylamine, ditetradecylamine, dipentadecylamine, dihexadecylamine, distearylamine, dioleylamine, bis(2-hexyldecyl)amine, bis(2-octyldodecyl)amine, bis(2-decyltetradecyl)amine, beef tallow dialkylamine, hardened beef tallow dialkylamine, and soybean oil dialkylamine; and trialk(en)ylamines such as tetradecyldimethylamine, hexadecyldimethylamine, octadecyldimethylamine, beef tallow alkyldimethylamine, hardened beef tallow alkyldimethylamine, soybean oil alkyldimethylamine, dioleylmethylamine, tritetradecylamine, tristearylamine, and trioleylamine. Suitable secondary amines have two alkyl (or alkenyl) groups with 14 to 18 carbon atoms.

Examples of the compound containing the hexavalent molybdenum atom include molybdenum trioxides or hydrates thereof ($MoO_3.nH_2O$), molybdenum acid ($H_2MoO_4$), alkali metal molybdates ($Q_2MoO_4$) wherein Q represents an alkali metal, such as sodium or potassium, ammonium molybdates {$(NH4)_2MoO_4$ or heptamolybdate $(NH_4)_6[Mo_7O_{24}]4H_2O$}, $MoOCl_4$, $MoO_2Cl_2$, $MoO_2Br_2$, $Mo_2O_3Cl_6$, and the like. Molybdenum trioxides or hydrates thereof, molybdenum acid, alkali metal molybdates and ammonium molybdates are often suitable because of their availability. In one embodiment, the lubricating composition comprises molybdenum amine compound.

Other organomolybdenum compounds of the invention may be the reaction products of fatty oils, mono-alkylated alkylene diamines and a molybdenum source. Materials of this sort are generally made in two steps, a first step involving the preparation of an aminoamide/glyceride mixture at high temperature, and a second step involving incorporation of the molybdenum.

Examples of fatty oils that may be used include cottonseed oil, groundnut oil, coconut oil, linseed oil, palm kernel oil, olive oil, corn oil, palm oil, castor oil, rapeseed oil (low or high erucic acids), soyabean oil, sunflower oil, herring oil, sardine oil, and tallow. These fatty oils are generally known as glyceryl esters of fatty acids, triacylglycerols or triglycerides.

Examples of some mono-alkylated alkylene diamines that may be used include methylaminopropylamine, methylaminoethylamine, butylaminopropylamine, butylaminoethylamine, octylaminopropylamine, octylaminoethylamine, dodecylaminopropylamine, dodecylaminoethylamine, hexadecylaminopropylamine, hexadecylaminoethylamine, octadecyl-aminopropylamine, octadecylaminoethylamine, isopropyloxypropyl-1,3-diaminopropane, and octyloxypropyl-1,3-diaminopropane. Mono-alkylated alkylene diamines derived from fatty acids may also be used. Examples include N-coco alkyl-1,3-propanediamine (Duomeen®C), N-tall oil alkyl-1,3-propanediamine (Duomeen®T) and N-oleyl-1,3-propanediamine (Duomeen®O), all commercially available from Akzo Nobel.

Sources of molybdenum for incorporation into the fatty oil/diamine complex are generally oxygen-containing molybdenum compounds include, similar to those above, ammonium molybdates, sodium molybdate, molybdenum oxides and mixtures thereof. One suitable molybdenum source comprises molybdenum trioxide ($MoO_3$).

Nitrogen-containing molybdenum compounds which are commercially available include, for example, Sakuralube® 710 available from Adeka which is a molybdenum amine compound, and Molyvan® 855, available from R.T. Vanderbilt.

The nitrogen-containing molybdenum compound may be present in the lubricant composition at 0.005 to 2 wt. % of the composition, or 0.01 to 1.3 wt. %, or 0.02 to 1.0 wt. % of the composition. The molybdenum compound may provide the lubricant composition with 0 to 1000 ppm, or 5 to 1000 ppm, or 10 to 750 ppm 5 ppm to 300 ppm, or 20 ppm to 250 ppm of molybdenum.

L. Demulsifiers

Demulsifiers useful herein include trialkyl phosphates, and various polymers and copolymers of ethylene glycol, ethylene oxide, propylene oxide, and mixtures thereof.

M. Seal Swell Agents

Seal swell agents useful herein include sulfolene derivatives such as Exxon Necton-37™ (FN 1380) and Exxon Mineral Seal Oil™ (FN 3200).

Example Lubricating Compositions

An engine lubricant in different embodiments may have a composition as illustrated in Table 1. All additives are expressed on an oil-free basis.

TABLE 1

Example Lubricating Composition

| Additive | Embodiments (wt. %) A | B | C |
|---|---|---|---|
| Example compound | 0.4 to 5 | 0.5 to 3 | 1 to 2 |
| Overbased Detergent | 2 to 9 | 3 to 8 | 3 to 5 |
| Dispersant Viscosity Modifier | 0 to 5 | 0 to 4 | 0.05 to 2 |
| Dispersant | 0 to 12 | 0 to 8 | 0.5 to 6 |
| Antioxidant | 0.1 to 13 | 0.1 to 10 | 0.5 to 5 |
| Antiwear Agent | 0.1 to 15 | 0.1 to 10 | 0.3 to 5 |
| Friction Modifier | 0.01 to 6 | 0.05 to 4 | 0.1 to 2 |
| Viscosity Modifier | 0 to 10 | 0.5 to 8 | 1 to 6 |
| Any Other Performance Additive | 0 to 10 | 0 to 8 | 0 to 6 |
| Oil of Lubricating Viscosity | Balance to 100% | Balance to 100% | Balance to 100% |

Use of the Lubricating Composition

The end use of the lubricating composition described herein includes use as a cylinder lubricant for an internal combustion engine, such as a 2-stroke marine diesel engine, but may also find use as an engine oil for passenger car, heavy, medium and light duty diesel vehicles, small engines such as motorcycle and 2-stroke oil engines, as a driveline lubricant, including gear and automatic transmission oils, and for other industrial oils, such as hydraulic lubricants.

An exemplary method of lubricating a mechanical device, such as a 2-stroke marine diesel engine cylinder, includes supplying the exemplary lubricating composition to the device.

Generally, the lubricating composition is added to the lubricating system of an internal combustion engine, which then delivers the lubricating composition to the cylinder of the engine, during its operation, where it may be combusted with the fuel.

The internal combustion engine may be a diesel-fuelled engine, such as a 2-stroke marine diesel engine, or a gasoline fuelled engine, a natural gas fuelled engine, a mixed gasoline/alcohol fuelled engine, or a biodiesel fuelled engine. The internal combustion engine may be a 2-stroke or 4-stroke engine.

In one embodiment the disclosed technology provides a method of lubricating a 2-stroke or 4-stroke marine diesel internal combustion engine comprising supplying to the internal combustion engine a lubricating composition disclosed herein. The lubricating composition is typically used to lubricate the 2-stroke marine diesel cylinder liner.

The two-stroke marine diesel engine may be a 2-stroke, cross-head slow-speed compression-ignited engine usually has a speed of below 200 rpm, such as, for example, 10-200 rpm or 60-200 rpm.

The fuel of the 2-stroke marine diesel engine may contain a sulfur content of up to 5000 ppm, or up to 3000, or up to 1000 ppm of sulfur. For example the sulfur content may be 200 ppm to 5000 ppm, or 500 ppm to 4500 ppm, or 750 ppm to 2000 ppm.

The internal combustion engine may also be a heavy duty diesel internal combustion engine.

The heavy duty diesel internal combustion engine may have a "technically permissible maximum laden mass" over 3,500 kg. The engine may be a compression ignition engine or a positive ignition natural gas (NG) or LPG (liquefied petroleum gas) engine. The internal combustion engine may be a passenger car internal combustion engine. The passenger car engine may be operated on unleaded gasoline. Unleaded gasoline is well known in the art and is defined by British Standard BS EN 228:2008 (entitled "Automotive Fuels—Unleaded Petrol—Requirements and Test Methods").

The passenger car internal combustion engine may have a reference mass not exceeding 2610 kg.

The lubricating composition may be suitable for use as a cylinder lubricant irrespective of the sulfur, phosphorus or sulfated ash (ASTM D-874) content of the fuel. The sulfur content of the lubricating composition, which is particularly suited to use as an engine oil lubricant, may be 1 wt. % or less, or 0.8 wt. % or less, or 0.5 wt. % or less, or 0.3 wt. % or less. In one embodiment, the sulfur content may be in the range of 0.001 wt. % to 0.5 wt. or 0.01 wt. % to 0.3 wt. %. The phosphorus content may be 0.2 wt. % or less, or 0.12 wt. % or less, or 0.1 wt. % or less, or 0.085 wt. % or less, or 0.08 wt. % or less, or even 0.06 wt. % or less, 0.055 wt. % or less, or 0.05 wt. % or less. In one embodiment, the phosphorus content may be 100 ppm to 1000 ppm, or 200 ppm to 600 ppm. The total sulfated ash content may be 2 wt. % or less, or 1.5 wt. % or less, or 1.1 wt. % or less, or 1 wt. % or less, or 0.8 wt. % or less, or 0.5 wt. % or less, or 0.4 wt. % or less. In one embodiment, the sulfated ash content may be 0.05 wt. % to 0.9 wt. %, or 0.1 wt. % to 0.2 wt. % or to 0.45 wt. %.

Without intending to limit the scope of the exemplary embodiment, the following examples illustrate preparation and evaluation of example compounds.

Examples

All reactants and additives are expressed on an oil-free basis unless otherwise noted.

Preparation of 2-((2-Hydroxyhexadecyl)oxy)phenol

Catechol (143.1 g) is charged to a 1 L 4 neck round bottom flask equipped with a condenser, thermocouple, and addition funnel under a nitrogen blanket. The catechol is warmed to 110° C. until it flows. Potassium hydroxide (3.65 g) is then added in 1 portion and an exotherm is observed (maximum temperature of 165° C.). 2-tetradecyloxirane (350 g) is then added over 30 minutes; another exotherm is observed (180° C.). The reaction temperature is held at 155° C. for 6 hours, after which the reaction mixture is quenched in deionized water at ambient temperature. After cooling to room temperature, the product is isolated by filtration to give a waxy orange solid.

Example A: Preparation of Sulfurized Oxyalkylated-Catechol 2-((2-Hydroxyhexadecyl)oxy)phenol as prepared above (176.9 g) is charged to a 1 L, 4-necked round bottom flask equipped with overhead stirrer, addition funnel, and condenser under a nitrogen blanket. Toluene (200 mL) and diluent oil (120.5) are added and the mixture is heated to 40° C. while stirring. Sulfur monochloride (135 g) is charged to the additional funnel and added dropwise to the stirring reaction mixture. The reaction mixture is heated to 110° C. and held at temperature for 2 hours. The black mixture is vacuum stripped to remove toluene and filtered to produce a dark brown/black oil (Sulfur 5.6 wt. %).

Example B: Calcium Salt of Sulfurized Oxyalkylated-Catechol

The product of Example A (240 g) is charged to a 1 L 4-necked round bottom flask equipped with an overhead stirrer under a nitrogen blanket and heated to 50° C. while stirring. Methanol (41.6 g) is added in one portion while stirring and the temperature is increased to 57° C. Hydrated lime (44 g) is added over 15 minutes, and the temperature is increased to 80° C. Toluene (400 mL) is added to aid stirring of the mixture. After 1 hour, the mixture was filtered and stripped under vacuum at 120 C. Upon cooling to room temperature, a black solid was collected (Sulfur 4.84 wt. %; TBN 87.6 mg KOH/g)

Example C: Preparation of Sulfurized Oxyalkylated-Catechol 2-((2-Hydroxyhexadecyl)oxy)phenol (175 g) is charged to a 2 L 4-necked round bottom flask equipped with an overhead stirrer, under a nitrogen blanket. Toluene (200 g) and diluent oil (119 g) are added, and the mixture is heated to 40° C. Sulfur monochloride (16.9 g) is added dropwise over 30 minutes. The reaction mixture is warmed to 110° C. and held there for 2 hours. The reaction mixture is filtered warm and then vacuum stripped to remove volatiles to give a dark brown oil (273 g) (Sulfur 2.39 wt. %).

Example D: Calcium Salt of Sulfurized Oxyalkylated-Catechol

The product of Example C (100 g), diluent oil (69 g), toluene (120 mL), and methanol (7.5 g) are charged to a 500 mL 4-necked round bottom flask equipped with an overhead stirrer under a nitrogen blanket and heated to 50° C. while stirring. Hydrated lime (7.5 g) is added in portions and the mixture is warmed to 70° C. and stirred for 2 hours. The reaction mixture is heated to 115° C. to remove water and volatiles, diluted with hexanes (50 mL, and filtered to remove solids. The reaction mixture is vacuum stripped to remove volatiles to provide a dark brown oil (170 g) (Calcium 1.53 wt. %; TBN 42.2 mg KOH/g).

Example E: One Pot Preparation of Calcium Salted, Sulfurized Oxyalkylated Catechol 2-((2-Hydroxyhexadecyl)oxy)phenol (150 g), diluent oil (105 g), and ethylene glycol (2.7 g) are charged to a 1 L 4-necked round bottom flask equipped with an overhead stirrer and a condenser, under a nitrogen blanket; the reaction mixture was heated to 120° C. while stirring. Hydrated lime (7.7 g) is added to the reaction mixture in several portions. Sulfur (6.7 g) is added to the reaction mixture which is heated to 185° C. and held at temperature for 3 hours. Additional lime (11.1 g) is added and the mixture is stirred for 20 minutes. The reaction mixture is vacuum stripped at 225° C., cooled to 175° C., and filtered to yield a black oil (214 g). (Sulfur 0.95 wt. %; Calcium 2.8 wt. %; TBN 83.7 mg KOH/g).

TABLE 2 compares a lubricating composition containing the sulfur-coupled oxydodecane catecholate compound of Examples D and E with other lubricating compositions, as follows:

Sulfated ash wt. % is measured, herein, according to ASTM D874-13a, Standard Test Method for Sulfated Ash from Lubricating Oils and Additives, DOI: 10.1520/D0874, ASTM International, West Conshohocken, Pa., 2013.

Oxidative stability is measured by pressure differential calorimetry (PDSC) according to the ACEA E5 specification, CEC L-85-99. See, J. Z. Adamczewska, et al., "Oxidative Stability of Lubricants Measured by PDSC CEC L-85-T-99 Test Procedure," J. Thermal Analysis and calorimetry, Vo. 80, pp. 753-759 (2005), for further details of this test.

Rod and Filter deposits are measured according to the Thermo-Oxidation Engine Oil Simulation Test (TEOST) for deposits (ASTM D6335-09, Standard Test Method for Determination of High Temperature Deposits by Thermo-Oxidation Engine Oil Simulation Test, DOI: 10.1520/D6335-09, ASTM International, West Conshohocken, Pa., 2009).

TABLE 2

Lubricating Compositions

| | EX 1 | EX 2 | EX 3 | EX 4 | EX 5 |
|---|---|---|---|---|---|
| Group III Base Oil | BALANCE TO 100% | | | | |
| EXAMPLE D | | | | 3.7 | |
| EXAMPLE E | | | | | 2.24 |
| Ca Phenate[1] | 1.4 | | | | |
| Ca Salicylate[2] | | | 3.31 | | |
| Dispersant[3] | 4.9 | 4.9 | 4.9 | 4.9 | 4.9 |
| Ashless Antioxidant[4] | 2.8 | 2.8 | 2.8 | 2.8 | 2.8 |
| Ca sulfonate | 0.06 | 0.06 | 0.06 | 0.06 | 0.06 |
| Secondary Zinc Dialkyldithiophosphate | 0.44 | 0.44 | 0.44 | 0.44 | 0.44 |
| VI Improver[5] | 1.2 | 1.2 | 1.2 | 1.2 | 1.2 |
| Other Additives[6] | 0.76 | 0.76 | 0.76 | 0.76 | 0.76 |
| % Calcium | 0.128 | 0.015 | 0.209 | 0.070 | 0.092 |
| % Sulfur | 0.180 | 0.100 | 0.109 | 0.063 | 0.129 |
| TBN (D4739) | 3.59 | 1.08 | 6.25 | 2.23 | |
| Sulfated ash (D874) | 0.51 | 0.2 | 0.8 | 0.36 | |

1. 200 TBN Calcium sulfur-coupled phenate detergent
2. 300 TBN Calcium alkylsalicylate detergent
3. 18.5 TBN polyisobutylene succinimide prepared from high vinylidene polyisobutylene (Mn 1300)
4. Combination of alkylated diaryl amine and hindered phenol ester
5. Styrene-butadiene copolymer
6. Other additives include corrosion inhibitors, foam inhibitors, friction modifier, pour point depressant, and surfactants As shown in TABLE 3 below, the catecholate shows significantly lower ash and TBN than salicylate while showing higher sulfur incorporation. Oxidation times presented by the catecholate are also significantly better than those of the phenate baseline and salicylate.

TABLE 3

Oxidation and Deposit Testing

| | EX 1 | EX 2 | EX 3 | EX 4 | EX 5 |
|---|---|---|---|---|---|
| Oxidation PDSC L-85-99 Comparison | | | | | |
| OIT (minutes) | 207 | 175 | 221 | 181 | 207 |
| Komatsu Hot Tube | | | | | |
| Test Temp. (° C.) | 280 | 280 | 280 | 280 | 280 |
| Tube Rating Visual | 1 | 7 | 8 | 7 | 6 |
| Whole No. Rating | 1 | 7 | 8 | 7 | 6.5 |
| Panel Coker | | | | | |
| % Universal Rating | 92 | 50 | 49 | 81 | 83 |
| ASTM D6335 - TEOST 33C | | | | | |
| Rod Deposits | 6.7 | 21.7 | 21.8 | 17.2 | 6 |
| Filter Deposits | 15.5 | 2.9 | 6.6 | 2 | 4 |

As used herein, the term "comprising" is inclusive and does not exclude additional, un-recited elements or method steps. However, in each recitation of "comprising" herein, it is intended that the term also encompass, as alternative embodiments, the phrases "consisting essentially of" and "consisting of," where "consisting of" excludes any element or steps not specified and "consisting essentially of" permits the inclusion of additional un-recited elements or steps that do not materially affect the basic and novel, and essential characteristics of the composition or method under consideration.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil, which may be customarily present in the commercial material, unless otherwise indicated. It is to be understood that the upper and lower amount, range, and ratio limits set forth herein may be independently combined. Similarly, the ranges and amounts for each element of the invention may be used together with ranges or amounts for any of the other elements.

It will be appreciated that variants of the above-disclosed and other features and functions, or alternatives thereof, may be combined into many other different systems or applications. Various presently unforeseen or unanticipated alternatives, modifications, variations or improvements therein may be subsequently made by those skilled in the art which are also intended to be encompassed by the following claims.

What is claimed is:

1. A lubricating composition comprising:

at least 0.2 wt. % of a sulfurized oxy-substituted aromatic polyol compound, the compound comprising at least one of a sulfurized oxy-substituted aromatic polyol and a salt of a sulfurized oxy-substituted aromatic polyol; and an oil of lubricating viscosity, wherein the sulfurized oxy-substituted aromatic polyol or salt thereof is the reaction product of an oxy-substituted polyol, a sulfurizing agent, and optionally a metal base or a pnictogen base, the oxy-substituted polyol being represented by the formula:

Formula I

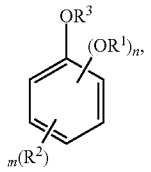

wherein each $R^1$ is independently selected from hydrocarbyl groups of 1 to 24 carbon atoms, hydroxyl substituted hydrocarbyl groups of 2 to 24 carbon atoms, (poly)ether groups, acyl groups, and mixtures thereof;

each $R^2$ is selected from hydrocarbyl groups of 1 to 48 carbon atoms, hydroxyl substituted hydrocarbyl groups of 2 to 24 carbon atoms, (poly)ether groups, groups in which two $R^2$ groups together form a 5- or 6-membered ring, and mixtures thereof;

$R^3$ is selected from H and hydroxyl substituted hydrocarbyl groups of 2 to 24 carbon atoms, and mixtures thereof;

wherein the oxy-substituted aromatic polyol compound is an oxy-$C_1$-$C_{30}$ alkyl-substituted catecholate;

n is at least 1; and m is at least 0.

2. The composition of claim 1, wherein the sulfurized oxy-substituted aromatic polyol is represented by the formula:

Formula II

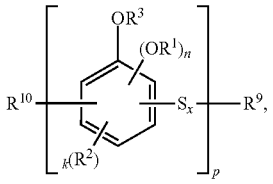

and salts thereof, $R^9$ is selected from hydrogen, hydrocarbyl groups of 1 to 18 carbon atoms, phenol, alkylated phenols, catechol, alkylated catechols, oxy-substituted aromatic polyols, and combinations thereof;

$R^{10}$ is selected from hydrogen, sulfhydryl, hydroxyl, hydrocarbyl groups of 1 to 48 carbon atoms, hydroxyl substituted hydrocarbyl groups of 2 to 24 carbon atoms, (poly)ether groups, a 5- or 6-membered ring, and mixtures thereof;

n is at least 1;

k is at least 0;

x is at least 1; and p is at least 1.

3. The composition of claim 2, wherein $R^9$ is selected from:

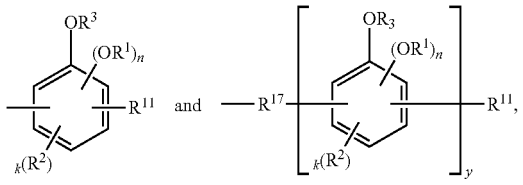

where $R^{11}$ is selected from hydrogen, sulfhydryl, and alkyl groups of 1-24 carbon atoms;

$R^{17}$ is an aromatic linking group, which is sulfurized or unsulfurized; and y is at least 1.

4. The composition of claim 1, wherein the sulfurized oxy-substituted aromatic polyol is represented by the formula:

Formula III

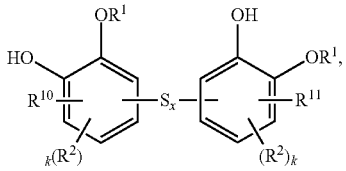

where $R^{10}$ is selected from hydrogen, sulfhydryl, hydroxyl, hydrocarbyl groups of 1 to 48 carbon atoms, hydroxyl substituted hydrocarbyl groups of 2 to 24 carbon atoms, (poly)ether groups, a 5- or 6-membered ring, and mixtures thereof; and $R^{11}$ is selected from hydrogen, sulfhydryl, and alkyl groups of 1-24 carbon atoms.

5. The composition of claim 1, wherein each $R^1$ is independently selected from alkyl groups including at least 8 carbon atoms.

6. The composition of claim 1, wherein the oxy-substituted aromatic polyol compound is an oxy alkyl substituted catecholate.

7. The composition of claim 1, wherein the oil of lubricating viscosity is at least 10 wt. % of the lubricating composition.

8. The composition of claim 1, wherein the sulfur-coupled oxy-substituted aromatic polyol compound is at least 1 wt. % of the lubricating composition.

9. The composition of claim 1, further comprising at least one of the group consisting of additional detergents, antioxidants, dispersants, antiwear agents, friction modifiers, and combinations thereof.

10. The composition of claim 1, wherein the composition is free of branched para-$C_{10-20}$-alkylphenols.

11. The composition of claim 1, wherein the oxy-substituted aromatic polyol compound is one in which at least one of two or more hydroxyl groups directly bonded to an aromatic ring is substituted with a non-aromatic organic group, which is thereby bonded to the aromatic ring by the oxygen of what was an OH group.

12. A method of lubricating a mechanical device comprising supplying to the device the lubricating composition of claim 1.

13. The method of claim 12, wherein the mechanical device comprises an engine or driveline device.

14. The composition of claim 1, wherein m is 0.

* * * * *